US012276120B2

(12) United States Patent
Gill

(10) Patent No.: US 12,276,120 B2
(45) Date of Patent: Apr. 15, 2025

(54) ROLLER FOR USE IN PLASTERBOARD FINISHING

(71) Applicant: Tape-Pro Drywall Tools Pty Limited, Burleigh Heads (AU)

(72) Inventor: Thomas Charles Gill, Burleigh Heads (AU)

(73) Assignee: Tape-Pro Drywall Tools Ply Limited, Burleigh Heads (AU)

( * ) Notice: Subject to any disclaimer, the term of this patent is extended or adjusted under 35 U.S.C. 154(b) by 130 days.

(21) Appl. No.: 18/122,551

(22) Filed: Mar. 16, 2023

(65) Prior Publication Data

US 2023/0304307 A1 Sep. 28, 2023

(30) Foreign Application Priority Data

Mar. 28, 2022 (AU) ..... 2022900784

(51) Int. Cl.
*E04F 21/165* (2006.01)

(52) U.S. Cl.
CPC ..... *E04F 21/1657* (2013.01)

(58) Field of Classification Search
CPC ..... E04F 21/1657
See application file for complete search history.

(56) References Cited

U.S. PATENT DOCUMENTS 2,533,209 A * 12/1950 Ames ..... E04F 21/00 156/461
5,203,954 A * 4/1993 Moore ..... E04F 21/00 156/577

(Continued)

FOREIGN PATENT DOCUMENTS

AU 2003200299 A1 8/2003
CA 2515473 A1 2/2007

(Continued)

OTHER PUBLICATIONS

Australian Patent Office International-Type Search Report (PCT Article 15(5) corresponding to AU National Application No. 2022900784 dated Oct. 24, 2022.

*Primary Examiner* — Jeffry H Aftergut
(74) *Attorney, Agent, or Firm* — Jenkins, Taylor & Hunt, P.A.

(57) ABSTRACT

A roller tool for use in plasterboard finishing is disclosed. The tool has a first wing and a second wing, and an edge portion of the first wing is pivotably connected to an edge portion of the second wing. The tool also has one or more first wing rollers connected to, and able to pivot/roll relative to, the first wing, and one or more second wing rollers connected to, and able to pivot/roll relative to, the second wing. In use, the tool can be pressed against surfaces on respective sides of a joint or line between adjacent plasterboard panels, such that the first wing roller(s) contact with the surface on one side of the joint or line and the second wing roller(s) contact with the surface on the other side of the joint or line. When the tool is thus pressed against the surfaces on respective sides of the joint or line between adjacent plasterboard panels, the first wing and the second wing are caused to align (by pivoting relative to one another, if necessary) with the plasterboard panels on the respective sides of the joint or line, such that the first wing roller(s) become(s) correctly oriented relative to the plasterboard panels on one side of the joint or line, and the second wing roller(s) become(s) correctly oriented relative to the plasterboard panel(s) on the other side of the joint or line.

16 Claims, 8 Drawing Sheets

(56) References Cited

U.S. PATENT DOCUMENTS

| | | | | |
|---|---|---|---|---|
| 6,450,232 | B1 * | 9/2002 | Smythe, Jr. | E04F 21/08 81/485 |
| D616,907 | S | 6/2010 | Eirich | |
| 9,938,731 | B1 * | 4/2018 | Wallace | E04F 21/1657 |
| 2005/0045264 | A1 * | 3/2005 | Kooistra | E04F 21/1655 401/5 |
| 2009/0090471 | A1 * | 4/2009 | Rosso | E04F 21/00 156/579 |

FOREIGN PATENT DOCUMENTS

| | | | |
|---|---|---|---|
| CN | 112411965 | A | 2/2021 |
| WO | WO-2021/209243 | A1 | 10/2021 |

* cited by examiner (i)

(ii)

(i)

(ii)

ROLLER FOR USE IN PLASTERBOARD FINISHING

CROSS-REFERENCE TO RELATED APPLICATION

This application claims priority to Australia Patent Application No. 2022900784, filed Mar. 28, 2022, the disclosure of which is incorporated herein by reference in its entirety.

TECHNICAL FIELD

The present invention relates generally to finishing tools for use in plasterboard (a.k.a. drywall) construction, and more specifically to rollers, particularly (but not exclusively) corner rollers, for use in plasterboard finishing.

BACKGROUND

In plasterboard construction (a.k.a. drywall construction), so-called "plasterboard" panels or sheets (a.k.a. "drywall" panels) are secured to framing to create surfaces of interior walls, ceilings and the like. The individual plasterboard panels (sheets) themselves are typically supplied with dimensions in the order of 3000 mm×1200 mm×10 mm, although panels can of course be supplied in different sizes, and in any case, they are (where necessary) cut to the required size and shape prior to installation. The plasterboard (drywall) panels themselves are made from a layer of gypsum plaster (or similar material) sandwiched between two outer layers of heavy-duty paper (or similar outer surface material). Thus, the internal layer in the panel (which is what provides the panel's rigidity) is already dry/set when the panels are supplied, and before the panels are cut to size (if necessary) and secured to framing to form e.g. part of a wall or ceiling surface. As a result, plasterboard panels are easy to secure in place, typically by simply nailing or screwing them to the underlying wall or ceiling framing.

The fact that the plaster layer within each plasterboard panel is already dry/set (and therefore solid) at the time when the panel is supplied (and before the panel is attached to the framing to form part of the wall or ceiling surface) is also the reason why plasterboard panels are sometimes known by the other common name, "drywall" panels/sheets.

When adjacent plasterboard panels are installed at an angle to one another, that is, to create a corner (which may be either an internal corner or an external corner) where the edge of the plasterboard panel (or the edges of the plasterboard panels) on one side of the corner meets with the adjoining edge of the other plasterboard panel (or with the adjoining edges of the other plasterboard panels) on the other side of the corner, there is generally a gap (or at least a line or join) between the edges of the panels on either side of the corner.

This gap or line/join between the panels on respective sides of a corner, regardless of whether the corner is an internal corner or on external corner, needs to be "finished". This "finishing" of the corner is important not only for cosmetic reasons (for example to ensure that any such gaps between panels on or in corners are filled and smoothed etc before being painted), but also because the finishing of such corner gaps and lines also has an important reinforcing purpose.

The finishing of the gaps and joints/lines between the panels on either side in an internal corner, as part of the finishing process, often involves applying a tape which is made of paper or a similar material. An example of such tape is visible in FIG. 1(*ii*), and the way in which a roller tool is often used to press (and embed) the tape into the finishing compound in an internal corner is also shown in FIG. 1(*ii*). This is also discussed further below.

The finishing of the gaps and joints/lines between the panels on either side on an external corner, as part of the finishing process, often involves applying a bead on to the external corner. Beads used for this purpose are typically made of plastic/polymer, metal (e.g. PVC, paper faced PVC, other plastics, other paper faced plastics, metal, paper faced metal etc) or some similar material that has at least a degree of inherent rigidity such that, when the external corner is finished, the bead helps to support the corner. An example image showing a bead (which in this case is a plastic bead) is given in FIG. 2(*ii*), and the way in which a roller tool is often used to press (and embed) the bead into the finishing compound on the external corner is also shown in this image. It is also worth noting that beads (which, unlike tape, often have a degree of inherent rigidity) are sometimes also used in the finishing of internal corners. However, tape is rarely used in the finishing of external corners.

In any case, the tape or bead (whichever is used in the finishing of a given corner) generally extends along at least most of the length of the corner, and the tape or bead (whichever is used) is adhered or secured to edge portions of the panels on either side of the corner. The tape or bead is often secured in place (secured to the edge portions of the panel on either side of the corner) by an adhesive paste, commonly referred to as finishing compound or simply "compound" or "mud". This compound can be applied in the form of a liquid or paste before the tape or bead is applied onto (or into) the corner. Alternatively, in some cases, the tape or bead may be supplied with some form of adhesive pre-applied to it (whilst this is possible for both tapes and beads, it is more commonly done with beads and not as common with tapes). For example, some beads are supplied with a water-activated adhesive already on them (i.e. on the relevant portions of the bead which are to become adhered to the panels on either side of the corner), such that all that is required is to wet the adhesive on these portions of the bead (to activate the adhesive) before pressing the bead on to (or into) the corner so that the portions of the bead which have the (activated) adhesive thereon then adhere to the edge portions of the surfaces of the panels on either side of the corner.

As alluded to above, the finishing of corners (e.g. by applying a tape or bead to "finish" in the corner, as described above), in addition to just covering the gap between the panels on either side of the corner for cosmetic purposes (i.e. in addition to the fact that this can allow a smooth finish to then be created over/in and along the corner gap prior to painting), also serves a reinforcing purpose. This is because the finishing (and the tape or bead used for this) can also help to reinforce the corner by helping to further secure the panels on either side of the corner relative to one another. For example, in cases where the tape or a bead is secured in place by an adhesive compound (or "mud") which is applied to the corner as a paste before the tape or bead is applied, the adhesive compound that secures the tape or bead may also become squeezed into the gap and at least partly fill the gap between the panels on either side of the corner. In such cases, when compound that has been squeezed into the gap between the panels sets, it helps to join/bond the panels on either side of the corner together, and this helps to reinforce the panels and the corner/joint between them. Also, as alluded to above, in cases where a bead (which itself has a degree of inherent rigidity) is used, the bead itself (especially once the bead has been properly pressed/embedded onto/into the corner and the adhesive has set) helps to reinforce the corner.

As also alluded to above, as part of the process of finishing a corner, after the tape or bead has been applied to the corner, but before the adhesive used to secure the tape or bead in place has set, it is common to use a roller to firmly press (embed) the tape or bead into/onto the corner, along the whole length thereof, thereby ensuring that the tape or bead is firmly secured/embedded (in the correct position) in the corner when the adhesive sets.

A range of rollers have traditionally been used for this purpose. For example, in order to roll tapes or beads that are applied as part of the finishing process in 90° internal corners, a range of "fixed" 90° internal corner rollers have been designed and are still commercially available and widely used. An example of one such "fixed" 90° internal corner roller is shown in FIG. 1. As shown in FIG. 1(*i*), this "fixed" 90° internal corner roller has (and others like it have) a first pair of rollers A and a second pair of rollers B. The rollers B are oriented perpendicular to the rollers A, such that when the tool is pressed firmly into and rolled along a 90° internal corner between two perpendicular plasterboard panels—i.e. after the adhesive and tape or bead have been applied, but before the adhesive sets—as shown in shown in FIG. 1(*ii*)—the rollers A will press against and roll along the side of the tape or bead which is to be adhered to the edge(s) of the panel(s) on one side of the corner (pressing the tape or bead into the adhesive on that side of corner), and the other perpendicular rollers B will simultaneously press against and roll along the other side of the tape or bead which is to be adhered to the edge(s) of the panel(s) on the other side of the corner (pressing the tape or bead into the adhesive on that other side of corner). FIG. 1(*ii*) illustrates the way the fixed 90° internal corner roller shown in FIG. 1(*i*) is used. More specifically, FIG. 1(*ii*) shows the tool in FIG. 1(*i*) being used to roll tape which has been applied to finish a 90° internal corner, that is, to firmly press (and embed) the tape into the finishing compound before the compound sets securing the respective edges of the tape to the edge portions of the plasterboard panels on the either side of the corner.

It can be seen in both images in FIG. 1 that the particular "fixed" 90° internal corner roller tool shown has an elongate handle. The handle is attached to, but can also pivot relative to, the body of the tool (the body is the part to which the rollers are mounted), such that the angle of the handle relative to the body of the tool changes as the tool is moved/rolled along a corner in use. The handle may often be length-adjustable (e.g. to enable the roller to be used at distances away from, or heights above, what the user could otherwise easily reach, for example when finishing corners between walls and ceilings and the like). Similar (often length-adjustable) handles may also be used on other forms of "fixed" 90° internal corner roller tools.

In order to roll the beads that are typically applied as part of the finishing process on 90° external corners, a range of "fixed" 90° external corner rollers have been designed and are still commercially available and widely used. An example of one such "fixed" 90° external corner roller is shown in FIG. 2. As shown in FIG. 2(*i*), this "fixed" 90° external corner roller has (and others like it have) a first pair of rollers C and a second pair of rollers D. The rollers D are oriented perpendicular to the rollers C, such that when the tool is pressed firmly onto and rolled along a 90° external corner—i.e. after the adhesive and bead have been applied, but before the adhesive sets—as shown in shown in FIG. 2(*ii*)—the rollers C will press against and roll along the side of the bead which is to be adhered to the edge(s) of the panel(s) on one side of the external corner (pressing the bead into the adhesive on that side of corner), and the other perpendicular rollers D will simultaneously press against and roll along the other side of the bead which is to be adhered to the edge(s) of the panel(s) on the other side of the external corner (pressing the bead into the adhesive on that other side of the external corner). FIG. 2(*ii*) illustrates the way that the fixed 90° external corner roller shown in FIG. 2(*i*) is used. More specifically, FIG. 2(*ii*) shows the tool in FIG. 2(*i*) being used to roll a bead to embed it into the joint compound that has been applied a 90° external corner, that is, to firmly press (and embed) the bead into the finishing compound before the compound sets securing the respective edges of the bead to the edge portions of the plasterboard panels on the either side of the corner.

Like the "fixed" 90° internal corner roller shown in FIG. 1, the "fixed" 90° external corner roller shown in FIG. 2 has an elongate handle. The handle is again attached to, but can also pivot relative to, the part of the tool to which the rollers are mounted, such that the angle of the handle can change as the tool is moved/rolled along a corner in use. The handle may often (again) be length adjustable.

The previous "fixed" 90° internal corner roller shown in FIG. 1 (and others like it) can, of course, only be used on internal corners, and specifically only on internal corners in which the plasterboard panels on either side of the corner form an internal corner with an angle of 90°. Likewise, the previous "fixed" 90° external corner roller shown in FIG. 2 (and others like it) can only be used on external corners where the panels on either side of the corner form an external corner with an angle of 90°. These kinds of "fixed" 90° internal/external corner rollers therefore cannot be used for corners with angles that are not 90°, i.e. they cannot be used on corners having angles other than 90°.

However, it is quite common in building and construction for internal and external corners to be created between e.g. walls, walls and ceilings, etc, that have angles that are not (i.e. angles that are other than) 90°.

Accordingly, a number of other tools have also previously been proposed which can be used for rolling internal and external corners in which the angle is not exactly 90°. In particular, a range of roller tools have been designed (and are available) for use in finishing corners having angles between the panels which are between 90° and 180° (i.e. 90°<corner angle 180°), and for finishing corners in which the angle between the panels is between 180° and 270° (i.e. 180° corner angle <270°), and also for finishing corners which are less than 90° or greater than 270°. Some such existing roller tools are "fixed" tools with a design that is generally similar to the tools shown in FIG. 1(*i*) or FIG. 2(*i*), in that the angle between the respective sets of rollers on the tool is fixed, except that (unlike the tools shown in FIG. 1 and FIG. 2) on these other tools the respective sets of rollers on the tool are angled so as to be adapted to suit the particular (fixed, but) non-90° corner angle for which the tool is designed. However, just like the fixed 90° tools shown in FIG. 1(*i*) and FIG. 2(*i*), these other "fixed" roller tools are also limited in that they can only be used in corners having the particular angle for which they are designed.

In an attempt to try and address this issue, a range of "adjustable" roller tools have also previously been proposed in which the angle between the respective sets of rollers of the tool can be adjusted so as to enable the same tool to be used to roll corners having a range of different angles. In general, these kinds of adjustable roller tools have a pair of wings, where each wing has a number of rollers, such that the rollers on each respective wing can be used to roll the tape or bead on either side of a corner, and the angle between the wings is able to be adjusted to enable the rollers on the respective wings to be used to roll portions of the tape or bead on either side of internal or external corners having a range of angles. Typically, such adjustable tools are able to be used on corners which are both less than 180° (internal corners) and more than 180° (external corners). In most of these adjustable tool designs, some kind of securing mechanism is provided such that, when the securing mechanism is released, the angle between the respective wings of the tool is able to be changed, but when the securing mechanism is engaged/tightened, the angle between the respective wings of the tool becomes fixed. Accordingly, with these previous kinds of adjustable roller tools, it is generally necessary to first release the tool's securing mechanism and then manually adjust (i.e. set) the angle between the respective wings of the tool to correctly orient the rollers on the respective wings to the required angle before then engaging/tightening the securing mechanism to fix the angle between the wings (and hence fix the orientation of the tool's rollers) before commencing use of the tool on a given corner.

U.S. Pat. No. 5,203,954 to Moore provides one example of an adjustable roller tool of the kind just described. The tool in U.S. Pat. No. 5,203,954 has two plates, each of which supports a number of rollers, and the rollers on the respective plates are intended to roll surfaces on the respective sides of a corner. The two plates of this tool are connected to one another via a hinge mechanism, so the angle of one plate relative to the other plate can be adjusted via the hinge mechanism. The hinge mechanism includes a threaded pin onto which is screwed a wingnut. Loosening the wingnut loosens the hinge mechanism so that the angle between the plates is able to be adjusted/changed. On the other hand, tightening the wingnut causes the plates to become secured/fixed relative to one another so that the angle between them is held fixed. Thus, before the tool in U.S. Pat. No. 5,203,954 is put to use, the wingnut can first be loosened to allow the plates to be moved/adjusted relative to one another so as to orient the plates (and thus the rollers of the respective plates) at the angle required to roll the surfaces on either side of the particular corner on which the tool is to be used. Then, once the angle between the plates has been correctly set, the wingnut can be tightened thereby securing the plates together with the desired angle between them, and thereafter the tool can be put to use for rolling the surfaces on either side of the corner.

U.S. Pat. No. 9,938,731 assigned to Columbia Taping Tools, Ltd. provides another example of a previous manually adjustable roller tool. The tool in U.S. Pat. No. 9,938,731, which Columbia Taping Tools refer to as its "Corner Cobra" tool has two wings, each of which supports a number of rollers. The rollers on the respective wings are intended to roll surfaces on the respective sides of a corner. The two wings of this tool are connected directly to one another in a pivotal manner such that the orientation of one of the wings relative to the other (i.e. the angle between the wings) is able to be changed. A particular mechanism is provided to enable the angle between the wings of this tool to be changed. This mechanism includes a pair of rods. One of the rods has one of its ends pivotably attached to one wing, and the other rod has one of its ends pivotably attached to the other wing. The other ends of the rods (i.e. the ends of the rods which are not connected to the respective wings) connect to a common support block. The support block is also the part that the tool's hand pivotably attaches to. Thus, both of the rods connect to the support block, and more specifically, each rod is pivotably connected to the support block so that the angle of orientation of the (each) rod relative to the support block can change. An adjusting wheel (or barrel adjuster) mechanism provided which extends between the rods at a location close to the support block. Turning the adjusting wheel (barrel adjuster) in one direction causes the rods to move in such a way that the ends of the rods where the respective rods connect to the wings move apart. This, in turn, causes the wings to open relative to one another, i.e. bringing them closer to being in a common plane with one another. Conversely, turning the adjusting wheel in the other direction causes the rods to move in such a way that the ends of the rods where the respective rods connect to the wings move toward one another. This, in turn, causes the wings to "close" relative to one another, i.e. decreasing the size of the internal or external corner angle between the wings. Turning the adjusting wheel (barrel adjuster) in the direction that causes the wings to "close" relative to one another may cause the wings to either (i) close towards each other in a way that would orient the wings for rolling for an increasingly acute internal corner, or alternatively (ii) close towards each other that would orient the wings for rolling an increasingly sharp external corner—this depends on how the wings are oriented relative to one another at the time when the user begins to turn the adjusting wheel in the direction that causes the wings to "close".

A problem with many previous manually adjustable roller tools, including tools like the ones in U.S. Pat. Nos. 5,203,954 and 9,938,731 just described (and others), is that, if the adjustment of the tool is inaccurate, i.e. if the angle between the wings (or plates) is not set so that the orientation of the rollers is perfectly set for (i.e. so that it perfectly/exactly matches) the angle of the particular corner (i.e. so that the rollers on the respective wings/plates of the tool press perfectly perpendicularly against the surface is on the respective sides of the corner), then when the tool (with the imperfectly angled the rollers) is used, the tape or bead is not pressed or bedded into the corner at the correct angle (e.g. the tape or bead may be pressed into the finishing compound, and it may become set, at an angle that does not match or is slightly different to the actual angle of the corner between the plasterboard panels). This can result in a poor (or at least an aesthetically suboptimal) finish.

Also, the adjustment of these previous manually adjustable tools is often difficult to get "right", i.e. it can be difficult to ensure that the angle between the wings (or plates) of the tool is adjusted to perfectly match the angle of the corner on or in which the tool is to be used. The difficulty with this can be particularly pronounced in situations where the angle between the wings of the roller needs to be set so that the tool can be used to roll perspective surfaces on either side of a joint or gap which are close to "flat", i.e. where the angle is close to 180°. In other words, with these previous manually adjustable tools, it is often inherently difficult to get the angle of the tool right (i.e. to ensure that the angle at which the wings/plates of the tool are set relative to one another exactly matches the angle of the particular corner on which the tool is to be used), but this is particularly difficult at near-180° geometries. This problem is particularly pronounced for the tool in U.S. Pat. No. 9,938,731 because that tool, due to its configuration, is practically unable to hold the two wings of the tool firmly and rigidly relative to one another if the angle between the wings is 180° or near-180°. The reason is because the wings of this tool have a natural tendency (due to the inherent design of the tool) to "pop" to an angle that is to one side or the other of the 180° (flat) configuration.

A related problem with these previous manually adjustable tools is that, because the tool must first be adjusted or "set" (i.e. with the orientation of respective wings or plates of the tool fixed/secured relative to one another) before the tool is used, consequently, these kinds of tools often perform relatively poorly when used on corners where the angle at which the plasterboard panels meet varies longer length of the corner. This (i.e. variation, even if only slight, in the exact angle between the plasterboard on either side of the corner) is relatively common, particularly on, for example, long corners between walls and ceilings, or the like, where the corner may run for most or all of the length of a building.

Another problem with a number of the manually adjustable roller tools that have previously been provided is that the means by which the respective wings of the tool are connected and made able to pivot/be adjusted relative to one another, and also the size and configuration of the securing mechanism by which the respective wings are secured (and released) relative to one another, often means that the location of the point where the tool's handle pivotally connects to the body of the tool (which includes the tool's wings/plates) is a considerable distance from the location where the rollers on the respective wings/plates actually press against the tape or bead. This relatively large distance between the locations where the rollers press against the tape or bead, and the location where the handle connects to the body of the tool, often results in these previous adjustable roller tools being quite unstable and difficult to use, and/or difficult to achieve a high-quality finish with. For example, this relatively large distance between the locations where the rollers press against the tape or bead, and the location where the handle connects to the body of the tool, can make it difficult to apply equal pressure to all of the tool's rollers at all times when the tool is in use.

The tool in U.S. Pat. No. 9,938,731 described above is an example of a tool for which this is a particular issue. Indeed, in this tool, there are numerous components (including the rods, the barrel adjuster, and support block) located in between where the rollers of the respective wings contact the surfaces to be rolled and where the tool's handle connects to the support block. In fact, in commercial versions of this tool, the distance between locations where the rollers of the respective wings contact the surfaces to be rolled and the location on the support block where the tool's handle connects is over 100 mm. This significant distance between the locations where the rollers of the respective wings contact the surfaces to be rolled and the location on the support block where the tool's handle connects means that it can be difficult for a user to apply constant and even pressure to all of the tool's rollers at the same time, which can mean that the surfaces to be rolled are not rolled evenly, which can lead to an uneven or less perfect finish.

Yet another problem with many of the previous manually adjustable roller tools like those described above (and others) is that they often use quite small diameter rollers, i.e. much smaller than the diameter of the rollers used on the kinds of "fixed" tools described above and shown in FIGS. 1 and 2. The reason rollers with a small diameter have often been used on these manually adjustable tools is in an attempt to enable the intersection of the edges of the rollers on the respective wings to get as close as possible to the pivot axis about which the wings of the tool pivot relative to one another. In this regard, it should also be noted that, in the previous manually adjustable roller tool in U.S. Pat. No. 9,938,731 discussed above (and other tools like this), the individual axes about which the individual rollers (on the tool's respective wings) rotate generally perpendicularly intersect (regardless of how the respective wings of the tool are oriented relative to one another) with the axis about which the respective wings pivot relative to one another. Given this geometry of the roller axes and the wing pivot axis in these previous tools, the purpose of using small diameter rollers on these tools is so that the inner edges of the rollers can get as close as possible to the pivot axis about which the wings of the tool pivot because this, in turn, helps, when the tool is being used to roll an internal corner (i.e. a corner having an angle less than 180°) to allow the inner edges of the rollers to get close to the apex of the corner. This is desirable because it is desirable for the inner portions of the tape or bead on either side of the internal corner to be pressed into the apex of the corner, and the closer the inner edges of the rollers can get to the apex of the corner, the better the tape or bead can be pressed into the apex of the corner. Thus, using rollers with a smaller diameter is how some of previous tools seek to enable the inner edges of the rollers to get close to the apex of the corner. However, rollers with a smaller diameter (as are typically used on many previous manually adjustable roller tools, for the reasons just explained) necessarily rotate faster for a given linear speed of movement of the tool than rollers having a larger diameter, and a consequence of this greater rotational speed of the (smaller diameter) rollers (for a given linear speed of the tool) is that such tools having these small diameter rollers are often more prone to "flicking" wet joint compound up as the tool moves along the corner during use.

It is thought that it would be desirable to provide a roller tool for use in drywall and plasterboard finishing, and also possibly for use in other applications, which helps to address or reduce one or more of the issues discussed above, or which at least provides an alternative to other roller tools currently available in the marketplace.

It is to be clearly understood that mere reference in this specification to any previous or existing devices, apparatus, products, systems, methods, practices, publications, patents, or indeed to any other information, or to any problems or issues, does not constitute an acknowledgement or admission that any of those things, whether individually or in any combination, formed part of the common general knowledge of those skilled in the field or is admissible prior art.

SUMMARY OF THE INVENTION

In a first form, albeit not necessarily the only or broadest form, the invention relates to a roller tool for use in plasterboard finishing, the tool having

- a first wing and a second wing, wherein (an edge portion of) the first wing is pivotably connected to (an edge portion of) the second wing,
- one or more first wing rollers connected to, and able to pivot/roll relative to, the first wing, and
- one or more second wing rollers connected to, and able to pivot/roll relative to, the second wing, wherein, in use, the tool can be pressed against surfaces on respective sides of a joint or line where adjacent plasterboard panels on either side of that joint or line meet or come together, such that the first wing roller(s) contact with the surface on one side of the joint or line and the second wing roller(s) contact with the surface on the other side of the joint or line (e.g. the tool may be pressed against a tape or bead that extends along the joint or line between adjacent plasterboard panels such that the first wing roller(s) contact with portions of the tape or bead that are to be adhered to the panel(s) on one side of the joint or line and the second wing roller(s) contact with portions of the tape or bead that are to be adhered with the panel(s) on the other side of the joint or line, and parts of the tool may also, at the same time, contact with portions of the plasterboard panels themselves on one or both sides of the joint or line e.g. on the outside of the tape or bead), and when the tool is pressed against the surfaces on the respective sides of the joint or line, the first wing and the second wing of the tool self-align (by pivoting relative to one another, if necessary) with the plasterboard panel(s) on the respective sides of the joint or line, such that the first wing roller(s) become(s) correctly oriented relative to the plasterboard panel(s) on one side of the joint or line (to press perpendicularly against (including while rolling along the surface of) the plasterboard panel(s) on that side of the joint or line), and the second wing roller(s) become(s) correctly oriented relative to the plasterboard panel(s) on the other side of the joint or line (to press perpendicularly against (including while rolling along the surface of) the plasterboard panel(s) on that other side of the joint or line).

In some embodiments, the first wing and the second wing may be symmetrical.

The first wing may have more than one first wing roller and/or the second wing may have more than one second wing roller. Also, one or both of the first wing and the second wing may include one or more additional rollers. The additional roller(s) may be positioned more outwardly, and it/they may help to provide stability, and/or it/they may assist the first wing rollers on the first wing and/or the second wing rollers on the second wing, as applicable, to roll the tape or bead).

The first wing and the second wing of the tool may be able to pivot relative to one another such that the angle between the first wing and the second wing on a surface-engaging side of the tool can be any angle in between (and including) two range extremes. At a first of the range extremes, the angle $\alpha$ between the first wing and the second wing on the surface-engaging side of the tool may be between 90° and 180°. Preferably, at the first of the range extremes, the angle $\alpha$ between the first wing and the second wing on the surface-engaging side of the tool may be at least as low as 90°. Even more preferably, at the first of the range extremes, the angle $\alpha$ between the first wing and the second wing on the surface-engaging side of the tool may be at least as low as 80°. Yet more preferably, at the first of the range extremes, the angle $\alpha$ between the first wing and the second wing on the surface-engaging side of the tool is at least as low as 75°.

At a second of the range extremes, the angle $\alpha$ between the first wing and the second wing on the surface-engaging side of the tool may be between 180° and 270°. Preferably, at the second of the range extremes, the angle $\alpha$ between the first wing and the second wing on the surface-engaging side of the tool may at least at as high as 270°. Even more preferably, at the second of the range extremes, the angle $\alpha$ between the first wing and the second wing on the surface-engaging side of the tool may be at least at as high as 280°. Yet more preferably, at the second of the range extremes, the angle $\alpha$ between the first wing and the second wing on the surface-engaging side of the tool is at least at as high as 285°.

The first wing and the second wing may both have one or more cut-outs and/or other shaped portions the shape and/or configuration of which helps to enable the first and second wings to pivot relative to one another without the roller(s) on one wing colliding with the other wing. Also, one or more of the first wing rollers may be mounted within a space within the first wing, and one or more of the second wing rollers may be mounted within a space within the second wing.

It is envisaged that, in most embodiments, it will be possible for a handle to be connected to the tool. The handle may be connected (often indirectly via one or more intermediate components) to the first wing and also (again indirectly via one or more intermediate components) to the second wing.

The tool may include a linking component, and the handle may be connected to the tool via the linking component. The tool may also have a first force transfer mechanism via which some force/pressure applied to the tool by the handle is transferred to the first wing, and a second force transfer mechanism via which some force/pressure applied to the tool by the handle is transferred to the second wing. Preferably, the amount of pressure/force from the handle which is transferred to the first wing by the first force transfer mechanism may be equal to the amount of pressure/force from the handle which is transferred to the second wing by the second force transfer mechanism. In some embodiments, the tool may include a first force transfer mechanism in the form of a first force transfer member (such as e.g. an arm or the like) which is pivotably connected to the first wing, and the tool may also include a second force transfer mechanism in the form of a second force transfer member (such as e.g. an arm or the like) which is pivotably connected to the second wing. In such embodiments, the first force transfer member (e.g. arm) and the second force transfer member (e.g. arm) may each also have a portion that is pivotally connected to the linking component. In some particular embodiments, the first and second force transfer members may both pivot relative to the linking component, but the movement of the first and second force transfer members relative to the linking component may also be "linked" such that the movement of the second force transfer member is always equal (in rate and amount of movement) and opposite (in direction) to the movement of the first force transfer member.

In some embodiments, an edge portion of the first wing may be connected to an edge portion of the second wing in a manner that permits the wings to pivot relative to one another about a wing pivot axis, and when the tool is configured with the first wing and the second wing pivoted relative to one another to enable the first wing rollers and the second wing rollers to roll respective sides of an internal corner having an angle that is less than 180°, the wing pivot axis may be located closer to the apex of the internal corner than a point of intersection between an axis about which the first wing roller(s) rotate and an axis about which the second wing roller(s) rotate.

In another form, albeit not necessarily the only or broadest form, the invention relates to a roller tool for use in plasterboard finishing, the tool having

- a first wing and second wing, wherein an edge portion of the first wing is connected to an edge portion of the second wing in a manner that permits the wings to pivot relative to one another about a wing pivot axis,
- one or more first wing rollers which are connected to, and which are able to pivot/roll relative to, the first wing about a first wing roller axis, and
- one or more second wing rollers which are connected to, and able to pivot/roll relative to, the second wing about a second wing roller axis, wherein, when the tool is configured with the first wing and the second wing pivoted relative to one another to enable the first wing rollers and the second wing rollers to roll in an internal corner having an angle that is less than 180°, the wing pivot axis is located closer to the apex of the internal corner than the point of intersection between the first wing roller axis and the second wing roller axis.

Features described in connection with one form of the invention above may also be used or incorporated in other forms of the invention.

Other features and aspects of the invention will be made evident from the Detailed Description below.

BRIEF DESCRIPTION OF THE FIGURES

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description makes reference to a number of Figures as follows:

FIG. 1(*i*) is an image of an existing (prior art) "fixed" 90° internal corner roller. The way in which this roller tool can be used to press (and embed) e.g. tape into the finishing compound in an internal corner is shown in FIG. 1(*ii*).

FIG. 2(*i*) is an image of an existing (prior art) "fixed" 90° external corner roller. The way in which this roller tool can be used to press (and embed) e.g. a bead into the finishing compound on an external corner is shown in FIG. 2(*ii*).

In FIG. 3, the angle between the wings of the tool on the surface-engaging side of the tool (and hence the angle on the surface-engaging side of the tool between the rollers on the respective wings in this embodiment) is approximately 135°. However, as will be explained, the tool in this embodiment is self-adjusting in that the tool automatically conforms to the shape (and to the angle) of the internal or external corner on which the tool is being used (i.e. the tool conforms to the corner into which, or onto which, it is pressed). Accordingly, the orientation of the wings of the tool (relative to one another) shown in FIG. 3 (and hence the relative orientation of the rollers on the respective wings in FIG. 3, namely with the angle between them on the surface-engaging side of the tool being approximately 135°) is the orientation that the respective wings (and the rollers on the respective wings) would adopt if the tool were to be pressed onto an external corner having an angle of approximately 225°.

FIG. 4 shows the tool in a different configuration compared to FIG. 3. In FIG. 4, the angle between the respective wings of the tool on the surface-engaging side of the tool (and hence the angle on the surface-engaging side of the tool between the rollers on the respective wings) is approximately 225°. However, as mentioned above, the tool is self-adjusting and automatically conforms to the shape (and to the angle) of the internal or external corner on which the tool is being used. Accordingly, the orientation of the wings of the tool (relative to one another) shown in FIG. 4 (and hence the relative orientation of the rollers on the respective wings in FIG. 4, namely with the angle between them on the surface-engaging side of the tool being approximately 225°) is the orientation that the respective wings (and the rollers on the respective wings) would adopt if the tool were to be pressed into an internal corner having an angle of approximately 135°.

FIG. 5 shows the tool in a different configuration again compared to FIGS. 3 and 4. In FIG. 5, the angle between the respective wings of the tool on the surface-engaging side of the tool (and hence the angle on the surface-engaging side of the tool between the rollers on the respective wings) is approximately 270°. This is the orientation that the respective wings (and the rollers on the respective wings) would adopt if the tool were to be pressed into an internal corner having an angle of approximately 90°.

FIG. 6 shows the tool in a different configuration again. In FIG. 6, the angle between the respective wings of the tool (and hence the angle between the rollers on the respective wings of the tool) is 180°. This is the orientation that the respective wings (and the rollers on the respective sides) would adopt if the tool were to be pressed onto a flat surface (as opposed to into an internal corner or onto an external corner); that is, where the plasterboard panels on either side of a joint or line are in a common plane and the tape or bead that is applied to cover the joint or line (and which is being rolled using the tool) will ultimately also (possibly after further smoothing and finishing) form part of the same planar surface as the panels. For the avoidance of doubt, tools in accordance with the present invention (including the tool in the particular embodiment shown in FIGS. 3-13) can be used in this way.

FIG. 11 also shows one of the flexible bands that can be applied to one or both ends of the tool in order to act in a manner similar to a spring.

FIG. 12 also shows one of the flexible bands that can be applied to one or both ends of the tool to provide a resilient bias.

FIG. 13 shows the tool in the same configuration as FIGS. 5 and 12. The "end-on" view in FIG. 13 illustrates, in particular, the fact that the pivot axis about which the respective wings of the tool pivot relative to one another is offset from (and closer to the apex of an internal corner than) the location of the intersection between the axes of the respective rollers. In other words, the axis about which the respective wings of the tool pivot relative to one another is offset from, and it is closer to the apex of an internal corner than, the location where a plane which contains the axes about which the rollers on one wing rotate intersects with a plane which contains the axes about which the rollers on the other wing rotate.

DETAILED DESCRIPTION

Figure 1:
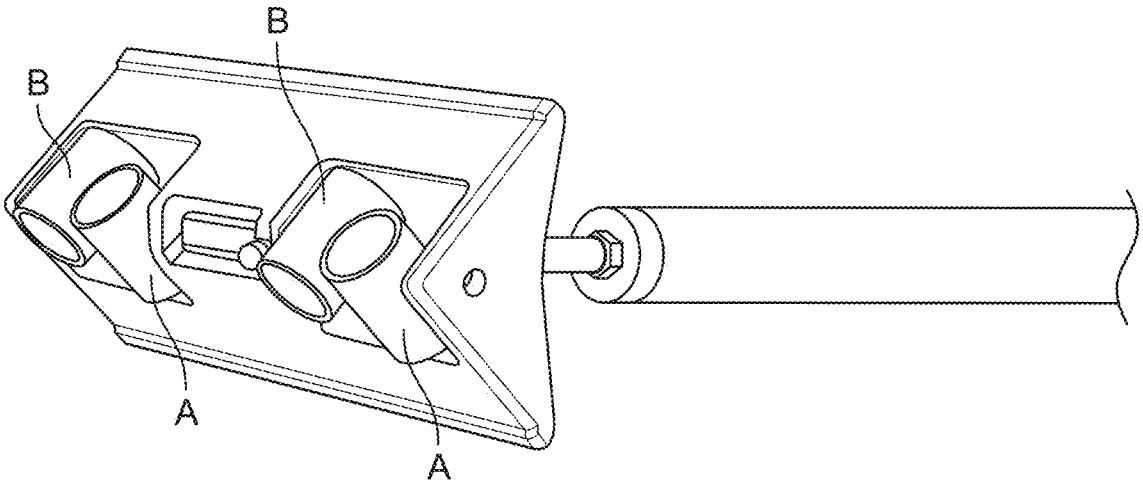
FIG. 1 (Prior Art)
FIG. 1 contains two images, namely FIG. 1(*i*) and FIG. 1(*ii*).
Figure 1:
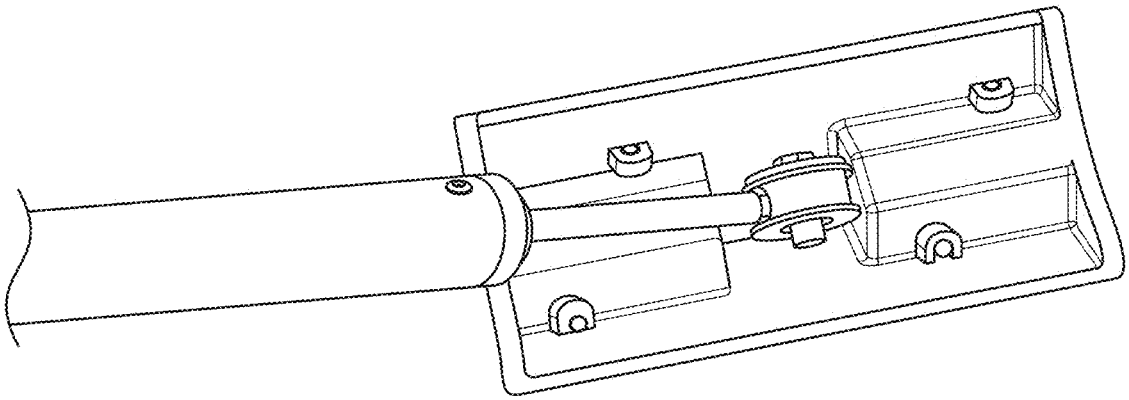
FIG. 1 (Prior Art)

As mentioned above, FIGS. 3-6 are each perspective views of a roller tool 10 for use in plasterboard finishing in accordance with an embodiment of the present invention. Each of these Figures shows the tool 10 in a different configuration. In other words, each of these Figures shows the tool 10 in a configuration which the tool would adopt if/when used to roll corners or surfaces where the angle between the plasterboard panels on the respective sides of the joint or line between the panels is different.

As the Figures show, the tool 10 has a first wing 100 and a second wing 200. The first wing 100 and the second wing 200 are pivotally connected to one another.

The first wing 100 and the second wing 200 are symmetrical. In other words, the shape of the first wing 100 and the shape of the second wing 200 are identical. Nevertheless, for ease of reference and for explanatory purposes, parts and features associated with the first wing 100 will be referred to using 1XX reference numbers, and parts and features associated with the second wing 200 will be referred to using 2XX reference numbers.

The first wing 100 is pivotally connected to the second wing 200 such that the two wings can pivot relative to one another about the wing pivot axis WP. The way in which the two wings are pivotally connected to one another is that there are a number of protruding noses on each wing. Specifically, the protruding nose portions on the first wing 100 are labelled 106, and the protruding nose portions on the second wing 200 are labelled 206. All of the nose portions 106 (being the ones on the first wing 100) and 206 (being the ones on the second wing 200) have a cylindrical through-bore extending therethrough in a direction parallel to the length direction of each wing. When the wings are brought together as the tool is being assembled, the nose portions 106 on the first wing are positioned directly adjacent to the corresponding nose portions 206 on the second wing, such that the through bores in each adjacent pair of nose portions 106/206 become aligned (and in fact the through bores in all of the nose portions 106/206 become aligned) along the wing pivot axis WP. A pivot pin (the length of which is the same as the length of the through bores in two of the nose portions combined) is then inserted into the aligned bores in each pair of nose portions 106/206, thereby securing each pair of nose portions 106/206 together. This in turn secures the first wing and the second wing together but still permits pivotable movement of the wings relative to one another about the wing pivot axis WP.

It can also be seen that, on the first wing 100, there are two first wing rollers 110 and 120. Likewise, on the second wing 200, there are two second wing rollers 210 and 220. The first wing rollers 110 and 120 on the first wing 100, and also the second wing rollers 210 and 220 on the second wing 200, are the tool's "main" rollers, i.e. these are the rollers that mainly function to press the tape or bead onto the surface when the tape or bead is being rolled using the tool. However, in addition to the main first wing rollers 110 and 120, and the main second wing rollers 210 and 220, there are also two outer rollers on each wing. The outer rollers on the first wing 100 are labelled 115 and 125, and the outer rollers on the second wing are labelled 215 and 225. The outer rollers 115, 125, 215, 225 on the respective wings provide stability to the tool. More specifically, the outer rollers provide stability in the transverse direction (i.e. in a direction perpendicular to the wing pivot axis WP) because they are located a greater distance away from the wing pivot axis WP than the main first wing rollers 110 and 120 and the main second wing rollers 210 and 220. The outer rollers also provide stability in the longitudinal direction (i.e. in a direction parallel to the wing pivot axis WP) because the outer rollers are located a greater distance apart in a direction parallel to wing pivot axis WP (i.e. the distance between rollers 115 and 125 on the first wing, which is the same as the distance between the rollers 215 and 225 on the second wing, is greater than the distance between any of the main rollers on the first and second wings in the longitudinal direction).

Figure 7:
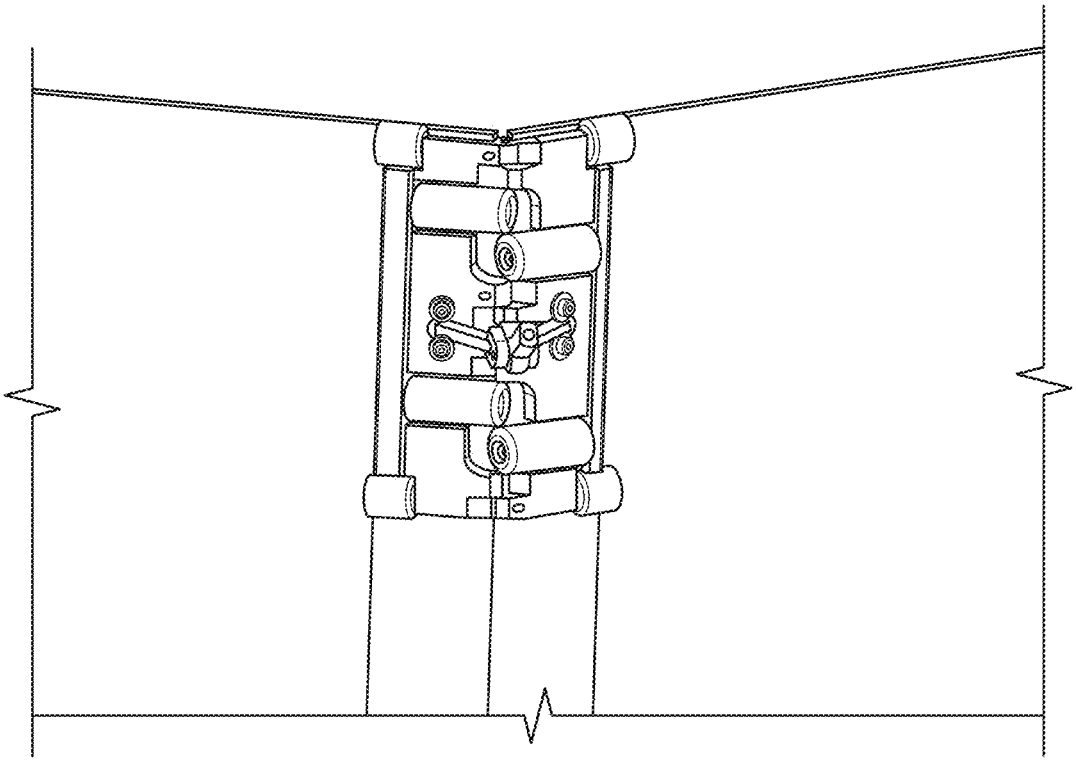
FIG. 7 illustrates the tool when it is being pressed onto (and when it is being used to roll) an external corner having an angle of approximately 225°.
Figure 8:
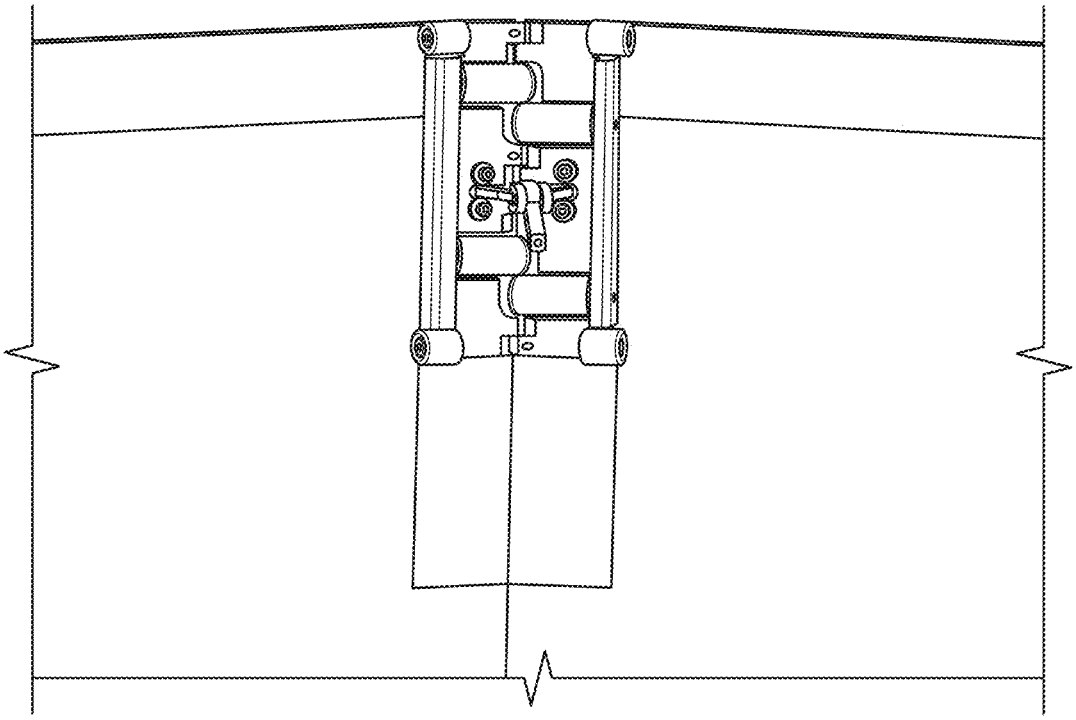
FIG. 8 illustrates the tool when it is being pressed into (and when it is being used to roll) an internal corner having an angle of approximately 135°.

In addition to providing stability, the outer rollers 115, 125, 215, 225 may sometimes also function to, or assist in, rolling the tape or bead, if the tape or bead that is being rolled is wide enough for the outer rollers to also come into contact with the tape or bead. FIGS. 7-8 provide examples where this is the case. FIG. 7 illustrates the tool 10 when it is being pressed onto (and when it is being used to roll) a bead that has been applied on an external corner having an angle of approximately 225°. In the example in FIG. 7, it can be seen that the bead that has been applied on the particular external corner shown is wide enough that the tool's main rollers (i.e. the first wing rollers 110, 120 on the first wing and the second wing rollers 210, 220 on the second wing) contact with and roll (the inner portions of) the bead, but the outer rollers 115, 125, 215, 225 also contact with and roll on the more outer portions of the bead.

Similarly, FIG. 8 illustrates the tool 10 when it is being pressed into (and when it is being used to roll) a bead that has been applied in an internal corner having an angle of approximately 135°. Again, it can be seen in FIG. 8 that the bead that has been applied on this particular internal corner is wide enough that tool's main rollers (i.e. the first wing rollers 110, 120 on the first wing and the second wing rollers 210, 220 on the second wing) contact with and roll (the inner portions of) the bead, but the outer rollers 115, 125, 215, 225 also contact with and roll the outer portions of the bead.

However, in some situations, the tape or bead which the tool is being used to roll may be thinner/narrower than the ones shown in FIGS. 7 and 8, in which case it may be that only the tool's main rollers (i.e. the first wing rollers 110, 120 and the second wing rollers 210, 220) come into contact with the bead (or possibly only parts of these main rollers may come into contact with the bead), and the outer rollers may then contact with the surface of the plasterboard panels themselves (on the outside of the bead).

As mentioned above, FIG. 3 shows the tool 10 in a configuration where the angle between the wings 100, 200 on the surface-engaging side of the tool is 135°. The surface-engaging side of the tool is the side of the tool where the rollers come into contact with the tape or bead or plasterboard (i.e. the side of the tool where the rollers come into contact with the surface being rolled) when the tool is in use. Basically, the surface-engaging side of the tool is the opposite side of the tool to the side which has the arms 150, 250, etc, via which the handle connects to the tool. The way in which the handle is connected to the tool, and the operation of the arms, etc, will be discussed further below.

Figure 3:
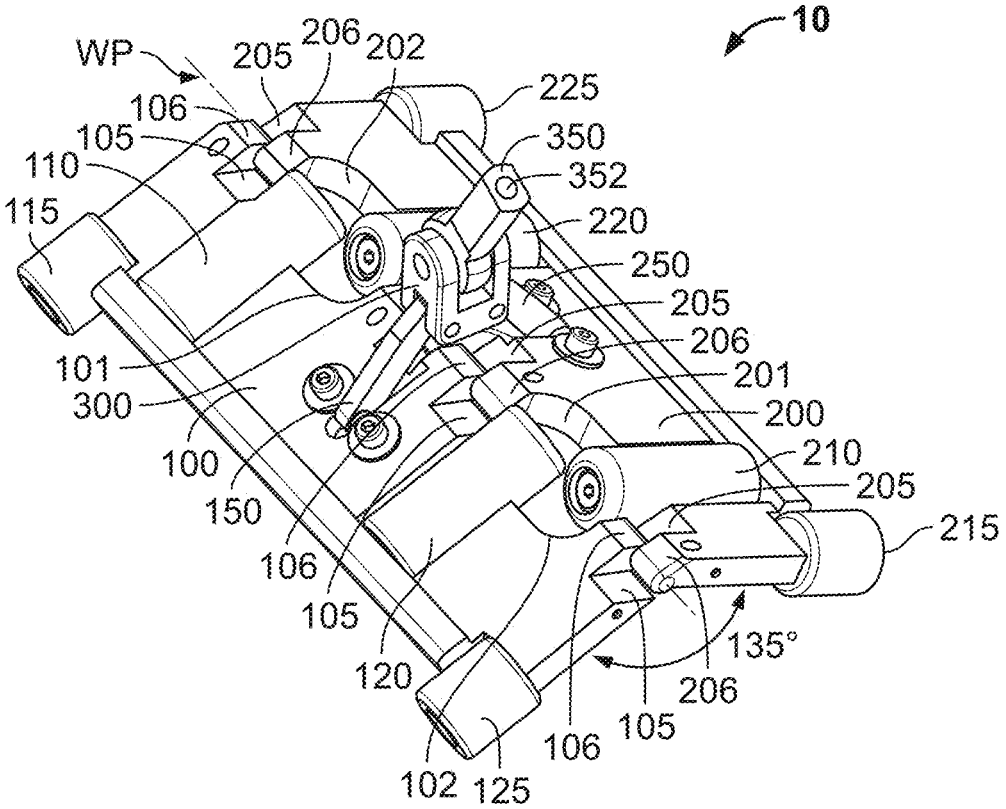
FIG. 3 is a perspective view of a roller tool for use in plasterboard finishing in accordance with an embodiment of the present invention.
Figure 4:
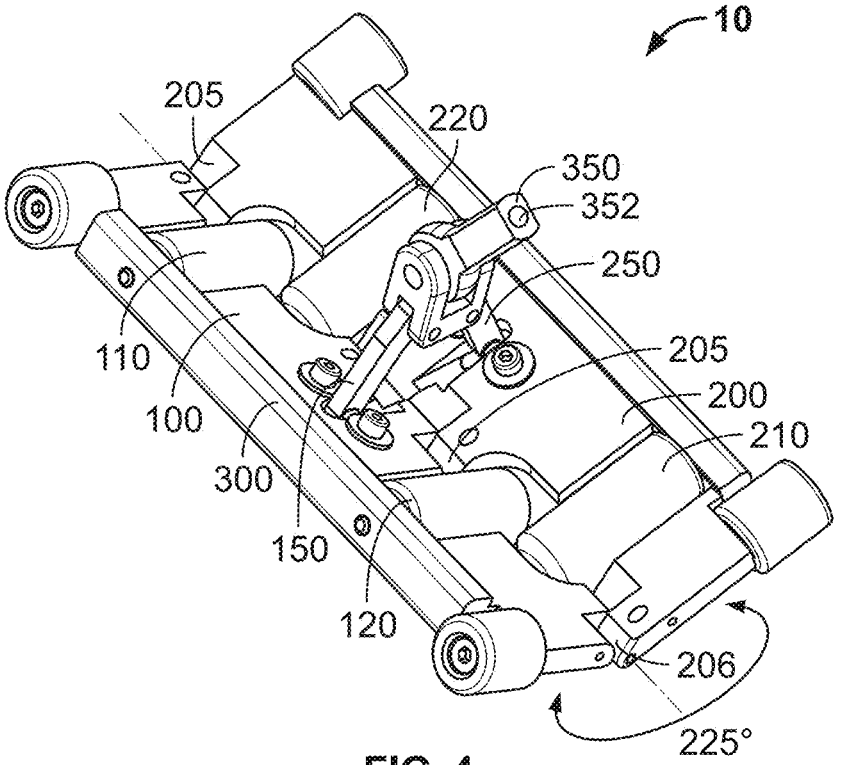
FIG. 4 is another perspective view of the same roller tool as shown in FIG. 3. However.
Figure 5:
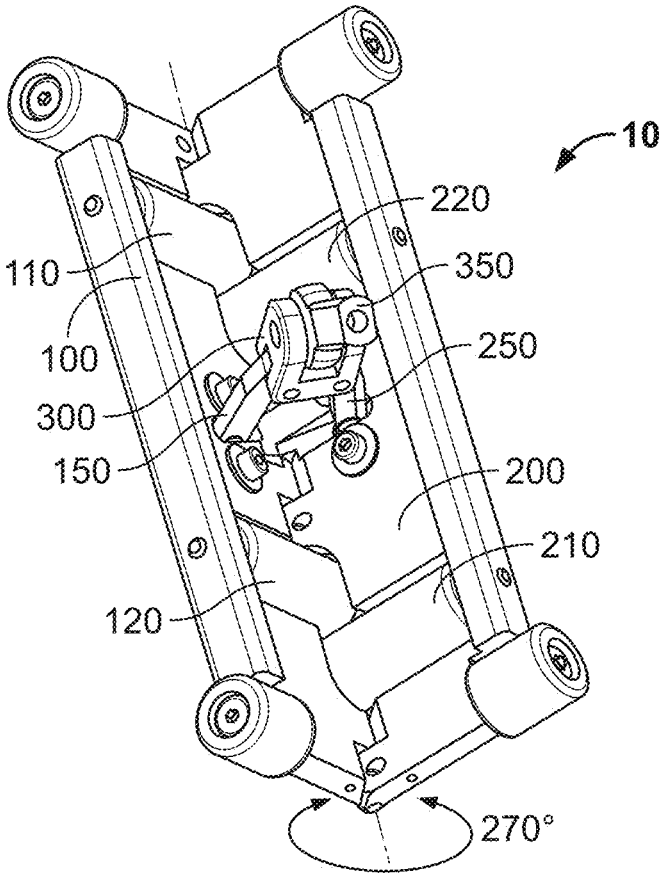
FIG. 5 is yet another perspective view of the same roller tool as shown in FIGS. 3 and 4.

Thus, FIG. 3 shows the tool 10 in the configuration where the angle between the wings 100, 200 on the surface-engaging side of the tool is 135°. FIGS. 4 and 5 show the tool in different configurations where the size of the angle on the surface-engaging side is progressively increased, with FIG. 4 showing the tool when the angle between the wings on the surface-engaging side is 225°, and FIG. 5 showing the tool when the angle between the wings on the surface-engaging side is 270°.

At this point, it is important to note that, on each of the wings 100, 200, there are a number of cut-outs and other specifically shaped portions, which will now be discussed.

On the first wing 100, there are a pair of cut-outs (or places where the edge of the wing 100 is indented/recessed) on the edge of the wing 100 nearest the wing pivot axis WP. These cut-out portions on the first wing are labelled 101 and 102 in FIG. 3. As mentioned above, the wings 100 and 200 are symmetrical (i.e. they have the same shape). Accordingly, on the second wing 200 there are also a pair of identical cut-outs (or places where the edge of the wing 200 is indented/recessed) on the side of the wing 200 nearest the wing pivot axis WP. The cut-out portions on the second wing are labelled 201 and 202 in FIG. 3.

The purpose of the cut-outs 101 and 102 in the first wing, and the cut-outs 201 and 202 in the second wing, can be understood by initially comparing FIGS. 3, 4 and 5.

Specifically, it can be seen from these Figures that, as the wings are pivoted relative to one another to progressively increase the size of the angle on the surface-engaging side of the tool up to and beyond 180° (or in other words when the wings are pivoted so as to progressively reduce the size of the angle between the wings on the non-surface-engaging side of the tool down to and below 180°), the inner ends of the first wing rollers 110 and 120 (i.e. the ends of these rollers that are closest to the wing pivot axis WP) move into the spaces provided by the cut-outs 202 and 201 in the second wing. Likewise, as the wings are pivoted relative to one another to progressively increase the size of the angle on the surface-engaging side of the tool up to and beyond 180°, the inner ends of the second ring rollers 210 and 220 move into the spaces provided by the cut-outs 102 and 101 in the first wing.

The cut-outs also serve a similar function when the wings are pivoted the opposite way relative to one another, that is, to reduce the size of the angle on the surface-engaging side of the tool down to and below 180° (or in other words to increase the size of the angle between the wings on the non-surface-engaging side of the tool up to and beyond 180°). An example of this is given in FIG. 11. Again, it will be appreciated that, as the wings are pivoted relative to one another to progressively decrease the size of the angle on the surface-engaging side of the tool down to and below 180°, the inner ends of the second wing rollers 210 and 220 move into the spaces provided by the cut-outs 102 and 101 in the first wing and the inner ends of the first wing rollers 110 and 120 move into the spaces provided by the cut-outs 202 and 201 in the second wing.

Figure 6:
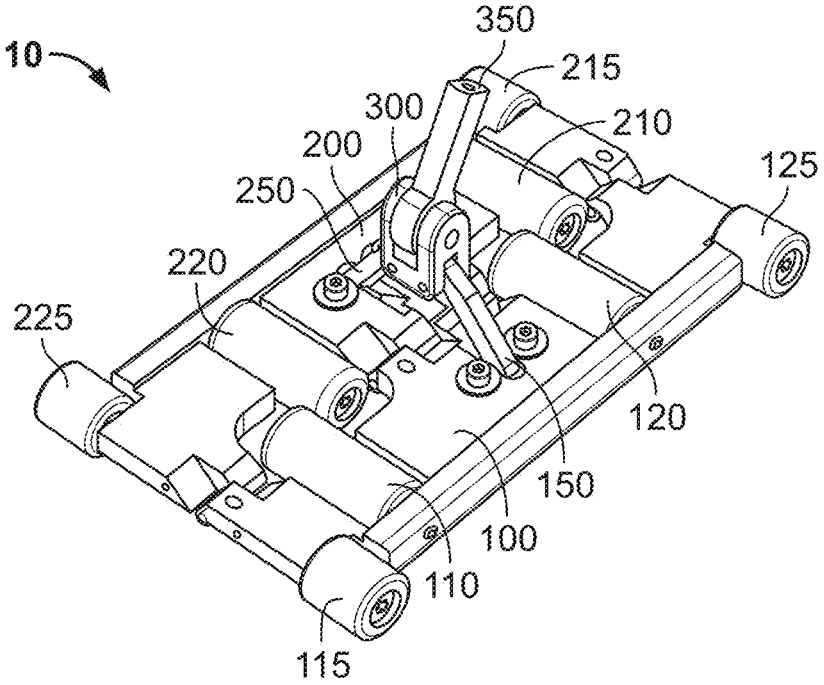
FIG. 6 is a further perspective view of the same roller tool as shown in FIGS. 3-5. However.

Therefore, the cut-outs 201 and 202 in the second wing 200 are important because they prevent the inner ends of the first wing rollers 110 and 120 from colliding with the second wing 200 when the wings are pivoted away from the "flat" 180° configuration shown in FIG. 6, and likewise the cut-outs 101 and 102 in the first wing 100 are important because they prevent the inner ends of the second wing rollers 210 and 220 from colliding with the first wing 100 when the wings are pivoted away from the "flat" 180° configuration. This is particularly important when the wings are pivoted relative to one another towards (or all the way to) either of the range extremes. In the particular embodiment shown, one of the range extremes is where the angle between the first wing 100 and the second wing 200 on the surface-engaging side of the tool is approximately 75°. Accordingly, at this first range extreme, the tool can be used to roll an external corner where the angle between the plasterboard panels on either side of the corner is approximately 285°. Also, in the particular embodiment shown, the other range extreme is where the angle between the first wing 100 and the second wing 200 on the surface-engaging side of the tool is approximately 285° (or in other words where the angle between the first wing 100 and the second wing 200 on the non-surface-engaging side of the tool is approximately 75°). At this second range extreme, the tool could therefore be used to roll an internal corner where the angle between the plasterboard panels on either side of the corner is approximately 75°. Therefore, the tool 10 in the particular embodiment shown in FIGS. 3-13 is capable of being used to roll internal or external corners (or flat surfaces) where the angle between the panels on either side of a line/gap between panels is anywhere in between these two range extremes.

The cut-out portions 101, 102, 201, 202 discussed above are important for enabling the tool to pivot without the main rollers on one wing colliding with the opposite wing, and consequently these cut-out portions help to allow the tool 10 to have a range of motion which extends from one of the range extremes described above to the other range extreme described above.

In addition, the cut-out portions 101, 102, 201, 202 are also important because they enable the tool to operate with larger-diameter main rollers. In this regard, the diameter of the main rollers 110, 120, 210, 220 is similar to the diameter of the rollers used on the fixed tools described in the Background section above. In other words, the diameter of the first wing rollers 110 and 120, and the diameter of the second wing rollers 210 and 220, is able to be larger than would be possible if the cut-outs 101, 102, 201, 202 were not provided. This means that the problems that can arise for adjustable tools with smaller diameter rollers, in particular their propensity to "flick" wet joint compound up as the tool moves along, is reduced. The diameter of the outer rollers 115, 125, 215, 225 is also the same as the diameter of the main rollers 110, 120, 210, 220, and therefore the outer rollers also have a reduced propensity to "flick" wet joint compound.

The cut-out portions 101, 102, 201, 202 also allow the main rollers 110, 120, 210, 220 to be longer than would be possible if those cut-out portions were not provided. In fact, the length of the main rollers 110, 120, 210, 220 is such that the inner ends of these main rollers extend beyond (i.e. past) the wing pivot axis WP. This enables the rollers (despite their larger diameter) to get very close to the apex in internal corners in particular, and to roll portions of the tape or bead in internal corners that are very close to the apex of the corner, where this would not have been possible (i.e. the inner ends of the main rollers would not have been able to get in as close to the apex in internal corners) if the cut-out portions 101, 102, 201, 202 were not provided.

It can also be seen from e.g. FIG. 3 that there are a number of sloping portions 105 (three of them) on the first wing 100, and likewise there are a number of (three) sloping portions 205 on the second wing 200. Each of the sloping portions 105 on the first wing is located directly opposite (across the wing pivot axis WP from) a respective one of the nose portions 206 on the second wing, and similarly, each of the sloping portions 205 on the second wing is located directly opposite (across the wing pivot axis WP from) a respective one of the nose portions 106 on the first wing.

The purpose of these sloping portions 105 and 205 can again be understood by comparing FIGS. 3, 4 and 5. Specifically, it can be seen from these Figures that as the wings are pivoted relative to one another to increase the size of the angle on the surface-engaging side of the tool up to and beyond 180°, the rounded and angled end portions of the respective nose portions 206 on the second wing 200 move into the spaces provided by the sloping portions 105 on the first wing. Likewise, the rounded and angled end portions of the respective nose portions 106 on the first wing 100 move into the spaces provided by the sloping portions 205 on the second wing. Thus, the fact that the sloping portions 105 are provided on the first wing 100 (opposite the nose portions 206 on the second wing 200) prevents the rounded and sloping surfaces on the second wing's nose portions 206 from colliding with the first wing, and vice versa, when the wings are pivoted in this way. This is especially important for enabling the tool to be able to move all the way to the range extreme where the angle between the wings on the surface-engaging side of the tool is greater than 270° (and in this particular embodiment the angle between the wings on the surface-engaging side of the tool at this range extreme is 285°).

In addition to the cut-out portions and shaped/sloping portions of the respective wings described above, on each wing there are also spaces provided for the various rollers to be mounted. For example, on the first wing, there are large gaps in the wing where (and into which) the first wing rollers 110 and 120 are mounted, and there are cut-outs (or indented portions) on the outer side of the first wing where the outer rollers 115 and 125 are secured on the outside of the wing at either end. All of these things are also present on the second wing 200 (the shape of which is identical to the first wing 100).

Figure 9:
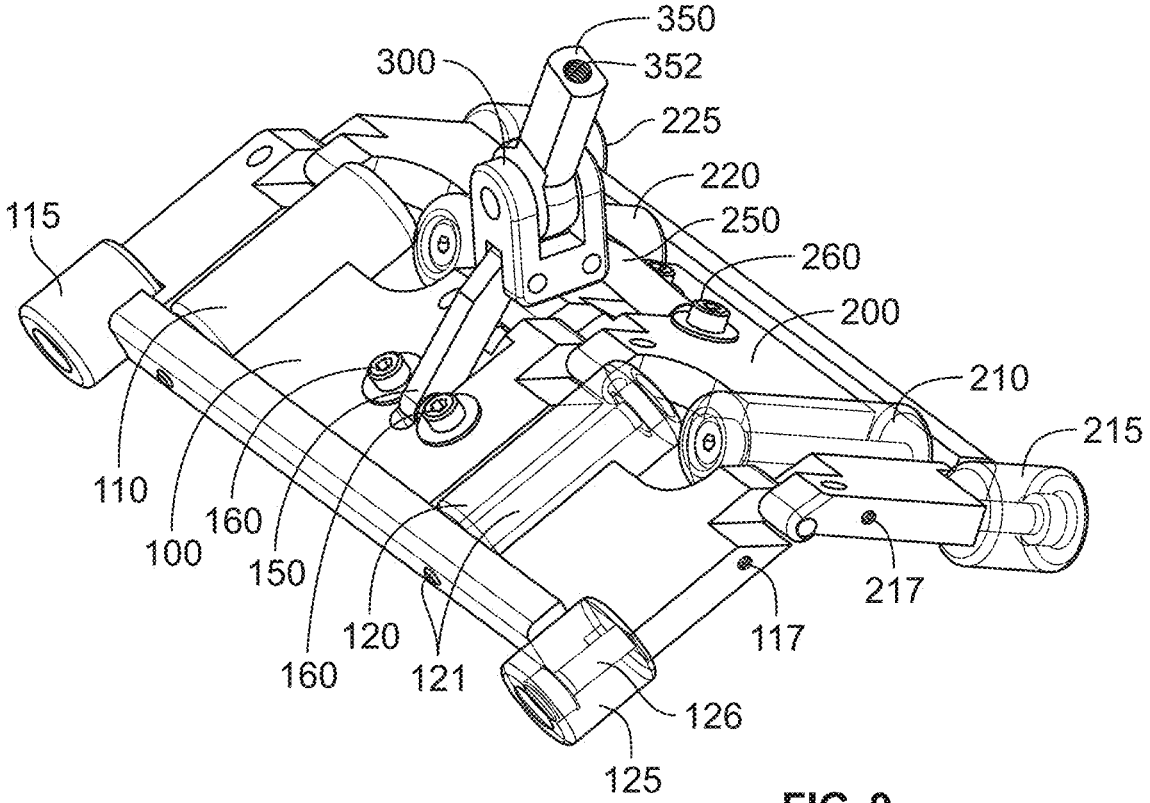
FIG. 9 is a perspective view of the same tool again, shown in a configuration similar to the one in FIG. 3, except that in FIG. 9 a number of the rollers of the tool have been made to appear transparent in order for the way in which they are secured to the respective wings of the tool, and their rotational axes, to be more easily seen and understood.

Turning next to FIG. 9, the image in this Figure is very similar to the image in FIG. 3, except that in FIG. 9 a number of the tool's rollers (specifically the first wing roller 120, the first wing outer roller 125, the second wing roller 210 and the second wing outer roller 215) have been made to appear transparent. This is so that the way in which these rollers are mounted to the respective wings can be seen and understood. The way in which the other rollers, namely those which are not made to appear transparent in FIG. 9, are mounted to the respective wings is the same. As shown in FIG. 9, each of the rollers is internally hollow and mounted on (and each roller rotates around) an axle bolt. Thus, for each roller, the axle bolt secures the roller to the relevant wing and also serves as the axle for the roller. For example, the first wing roller 120 (which is the one main first wing roller which has been made to appear transparent in FIG. 9) is mounted on an axle bolt 121. More specifically, when the tool 10 is being assembled, the cylindrical outer "roller" portion of the roller 120 (i.e. the outer body of the roller itself) is first slotted onto the axle bolt 121, and the axle bolt 121 (with the outer body of the roller 120 then mounted thereon) is then screwed into a hole in the outer edge of the wing 100 that is provided for this. The end of the axle bolt 121 can just be seen projecting from this hole on the outside edge of the first wing 100 and FIG. 9.

It should be noted that, on the axle bolt 121, only the end portion of the bolt's shaft, namely the portion which screws into the side of the wing 100, is threaded. The remainder of the bolt's shaft has a smooth surface and is un-threaded. This helps to provide a smooth (and lower friction) surface for the main body of the roller to rotate around. It should also be noted that the bolt 121 is (and indeed all of the other axle bolts are also) made from steel, and the body of the roller 120 is (and indeed the bodies of all of the rollers are) made from acetal, which is a high-strength, low friction engineering plastic. Of course, no strict limitation as to the particular materials used for the axle bolts or roller bodies is to be implied, and it will be understood that any suitable material may be used for the axle bolts and/or for the bodies of the rollers.

The way in which all of the other rollers are assembled and mounted to the respective wings is the same as just described for first wing roller 120. Thus, for example, when the tool is being assembled, the cylindrical outer 'roller" portion of the outer roller 125 (i.e. the outer body of the outer roller 125, which in the depicted embodiment is made from acetal) is first slotted onto the shaft of the axle bolt 126, and the axle bolt 126 (with the outer body of the roller 125 then mounted thereon) is then screwed into a hole in the indented end portion on the outer edge of the wing 100 that is provided for this.

In each case, the head of the axle bolt is larger in diameter than the hollow interior of the roller body, such that the head of the axle bolt prevents the roller from sliding off the bolt and thereby secures the body of the roller to the relevant wing.

The main rigid body portion of each of the wings 100 and 200 will typically be made from metal. It is thought that aluminium alloys will often be suitable because of the relative ease with which these can be cast and/or machined to have the appropriate shape, etc, and also because of their comparatively high-strength and rigidity, and low weight. In the particular embodiment depicted in, e.g., FIGS. 11 and 12, the material from which each of the wings 100 and 200 is made is 6061 aluminium. However, it is to be clearly understood that no strict limitation as to the particular material used to create the wings is to be implied, and a range of other aluminium alloys, or other metals (i.e. other than aluminium alloys), or indeed a range of other non-metal materials (such as e.g. engineering plastics, fibre reinforced composites, etc) could also be used. The same also applies for many of the other components of the tool 10, like e.g. the arms 150, 250, the linking component 300, handle mount 350, etc. In the particular embodiment shown, these are all made from 304 stainless steel, but a range of other metals or non-metal materials could also be used. Also, all of the various pivot pins and the like used in the tool may be made from any suitable metal or other material.

Figure 2:
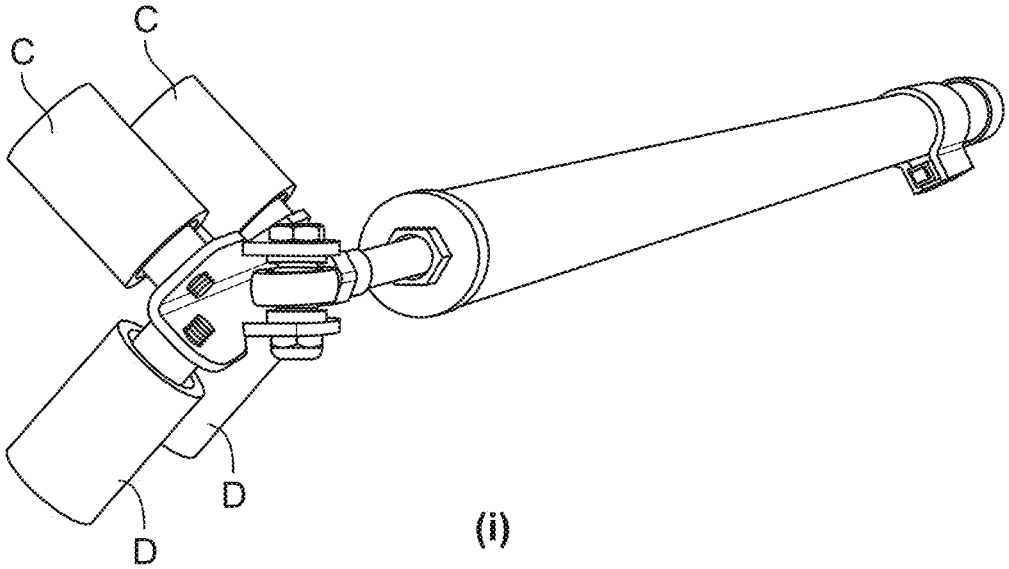
FIG. 2 (Prior Art)
FIG. 2 also contains two images, namely FIG. 2(*i*) and FIG. 2(*ii*).
Figure 2:
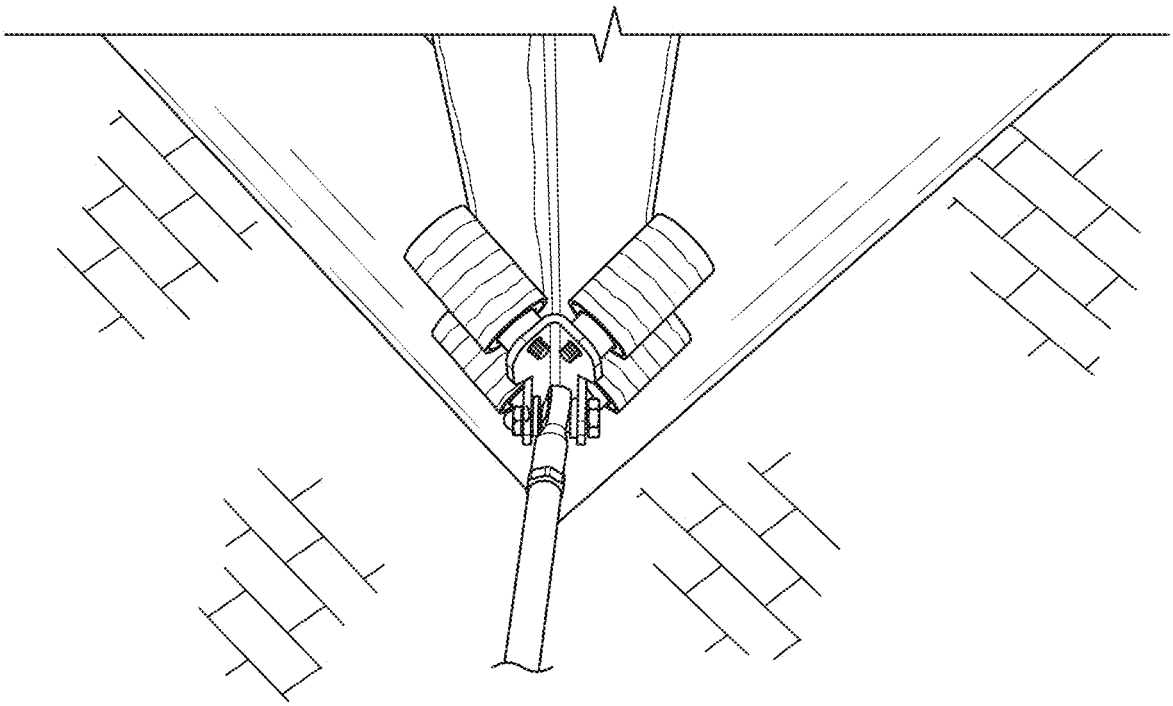
FIG. 2 (Prior Art)

As mentioned above, a handle (not shown in FIGS. 3-13) can be attached to the tool 10. The handle will generally be an elongate handle, i.e. generally similar to the elongate handles used on the "fixed" roller tools shown in FIGS. 1 and 2 above, and like the handles used on those previous "fixed" roller tools, the handle used with the tool 10 may be a fixed-length (i.e. non-extendable) handle, or it may be length-adjustable. In any case, the invention is not to be considered limited to, or by, any particular kind of handle.

The way in which the handle (not shown) connects to the tool 10 in the particular embodiment shown in FIGS. 3-13 is that a handle adapter component (not shown in any of the Figures) will be provided that has an externally threaded (i.e. male threaded) rod extending from the end, and that external (male) threaded rod on the handle adapter component (not shown) screws into the internally threaded (female threaded) bore 352 on the inside of the handle mount component 350. The handle adapter component (not shown) has an external (male) threaded portion on it. This external (male) threaded portion on the handle adapter component (not shown) is configured to match the internal (female) threaded portion that is typically provided on the kinds of conventional elongate tool handles used with these kinds of roller tools. Again, the handle itself is not shown in any of the accompanying Figures. Thus, when the threaded rod on the end of the handle adapter component (not shown) is screwed into the bore 352 in the handle mount component 350, the handle adapter component (not shown) becomes connected to (and it effectively then forms an extension of) the handle mount component 350, and the handle itself (not shown) with its internal (female) threaded portion can then be screwed onto the external (male) threaded portion on the handle adapter component, thereby connecting the handle to the tool 10.

The handle mount component 350 is pivotably attached to the linking component 300. The linking component 300 is the generally "shackle" shaped component via which the handle mount component 350 (and the handle adapter component, and the handle) connects to the arms 150 and 250, as discussed below. The fact that the handle mount component 350 (to which the adapter and handle are connected) is pivotable relative to the link component 300 means that, in a generally similar way to the fixed roller tools shown in FIGS. 1 and 2 above, the handle (when connected) can pivot relative to the rest of the tool 10 (the handle mount component 350 (and the adapter and the handle) pivot relative to the linking component 300 about an axis that is perpendicular to the wing pivot axis WP), such that the angle of the handle relative to the tool 10 changes as the tool is moved/rolled along a corner in use.

It should be noted that other mechanisms could alternatively be used for connecting the handle to the handle mount component. For example, a friction fit connection directly between the handle and the handle mount component could be used, or a part of the handle mount component to which the handle connects could be externally threaded such that the internally-threaded portion on the handle could connect directly thereto, etc. These alternatives would, of course, require the configuration of the handle mount component to be different to the one (350) shown in the Figures.

As mentioned above, the linking component 300 is the generally "shackle" shaped component via which the handle mount component 350 (and the handle adapter and the handle) connect to the arms 150 and 250. The arms 150 and 250 are the components that connect the linking component 300 to (and which transfer force/pressure from the handle into) the respective wings 100 and 200 when the tool 10 is in use. More specifically, there is a first arm 150 which connects the link component 300 to the first wing 100, and there is a second arm 250 which connects the link component 300 to the second wing 200. The upper end of each of the arms 150 and 250 is pivotally connected to the link component 300, and the lower end of each arm 150 and 250 is pivotally connected to the relevant wing, i.e. the lower end of the first arm 150 is pivotally connected to the first wing 100 and the lower end of the second arm 250 is pivotally connected to the second wing 200.

The operation of the arms 150 and 250 (i.e. how they work and the role they play in the functioning of the tool 10) may perhaps be more easily understood from (and following) a general explanation of the way in which the tool 10 is used. Therefore, before discussing further details about the configuration of the arms 150 and 250 and how they work, a general explanation of how the tool 10 is used will be provided.

Reference will be made initially to the way in which the tool 10 can be used to roll an external corner.

When the tool 10 is to be used to roll an external corner, if, before the tool comes into contact with the panels (or the bead) on either side of the external corner, the wings 100 and 200 of the tool are oriented (relative to one another) in a configuration that is more closed than the corner (i.e. if the angle between the wings 100 and 200 on the surface-engaging side of the tool 10 is smaller than the angle of the external corner to be rolled), then when tool first contacts the panels (or the bead) on either side of the corner, it will be the outer edges of the tool 10, in particular the outer rollers 115, 125, 215, 225, that will first come into contact with the panels (or the bead) on either side of the external corner. Then, when further pressure is applied to the tool 10 (i.e. when the tool is further pressed onto (and into engagement with) the corner) this pressure will force the tool further open. In other words, the respective wings 100 and 200 will be caused to pivot relative to one another such that the angle between the wings on the surface-engaging side widens/increases as the tool moves into full contact/engagement with the corner. This will continue until the main wing rollers 110, 120, 210, 220 come into full contact (i.e. until each of the main wing rollers 110, 120, 210, 220 is in contact along most or all of its length) with the bead on the respective sides of the external corner. Then, once the tool 10 is thus properly engaged with (and pressed against) the bead (and possibly also in contact with portions of the panels) on either side of the corner, the tool can be moved along the bead to "roll" the corner and embed the bead into the adhesive on the corner. (It should be noted that, in embodiments which utilise a flexible band to provide the tool with an inherent bias, as discussed below, it may sometimes be the case that before the tool comes into contact with the panels (or the bead) on either side of an external corner, the wings 100 and 200 of the tool may be oriented (relative to one another) in a configuration that is more closed than the corner (i.e. the angle between the wings 100 and 200 on the surface-engaging side of the tool 10 may be smaller than the angle of the external corner to be rolled). This is because the flexible band may bias the tool towards one or other of the tool's range extremes, and one of these range extremes is where the angle between the wings 100 and 200 on the surface-engaging side of the tool is minimum (approximately 75° in the depicted embodiment).)

Alternatively, if, before the tool comes into contact with the panels (or the bead) on either side of the external corner, the wings 100 and 200 of the tool are oriented (relative to one another) in a configuration that is more open than the corner (i.e. if the angle between the wings 100 and 200 on the surface-engaging side of the tool is larger than the angle of the external corner to be rolled), then when the tool first contacts the bead on either side of the corner, it will be the inner portions of the tool, in particular the inner portions of the main wing rollers 110, 120, 210, 220, that will first come into contact with the bead on either side of the corner. Then, when further pressure is applied to the tool (i.e. when the tool is further pressed onto (and into engagement with) the corner) this pressure will force the tool to effectively close around the corner. In other words, the respective wings 100 and 200 will be caused to pivot relative to one another such that the angle between the wings on the surface-engaging side decreases as the tool moves into full engagement with the corner, until most or all of the length of each main wing roller 110, 120, 210, 220 is in contact with the bead on the respective sides of the external corner, and the outer rollers 115, 125, 215, 225 may also be in contact with the bead or with portions of the panel on the outside of the bead on either side. Thereafter, once the tool 10 is thus properly engaged with (and pressed against) the bead (and possibly also in contact with portions of the panels) on either side of the external corner, the tool can be moved along the bead to "roll" the corner and embed the bead into the adhesive on the corner.

Reference will now be made to the way in which the tool 10 can be used to roll an internal corner.

When the tool 10 is to be used to roll an internal corner, if, before the tool comes into contact with the panels (or the tape or bead) on either side of the internal corner, the wings 100 and 200 of the tool are oriented (relative to one another) such that the angle between the wings on the surface-engaging side is not large enough (e.g. if the angle between the wings 100 and 200 on the surface-engaging side is, say, 225°, but the angle between the panels in the particular internal corner to be rolled is, say, 100°, which would therefore require the angle between the wings 100 and 200 on the surface-engaging side to be 260°), then when the tool first contacts the panels (or the tape or bead) on either side of the corner, it will again be the outer edges of the tool, in particular the outer rollers 115, 125, 215, 225, that will first come into contact with the panels (or the tape or bead) on either side of the internal corner. Then, when further pressure is applied to the tool (i.e. when the tool is further pressed into the internal corner) this pressure will force the tool further into the corner. In other words, the respective wings 100 and 200 will be caused to pivot relative to one another such that the angle between the wings on the surface-engaging side widens/increases further (i.e. so that the angle between the wings on the non-surface-engaging side decreases) as the tool moves into full engagement with the internal corner, until most or all of the length of each main wing roller 110, 120, 210, 220 is in contact with the tape or bead on the respective sides of the internal corner, and the outer rollers 115, 125, 215, 225 may also be in contact with the tape or bead or with portions of the panel on the outside of the tape or bead.

Or, if (on the other hand), before the tool comes into contact with the bead on either side of the internal corner, the wings 100 and 200 of the tool are oriented (relative to one another) such that the angle between the wings on the surface-engaging side is too large (e.g. if the angle between the wings 100 and 200 on the surface-engaging side is, say, 285°, but the angle between the panels in the particular internal corner to be rolled is, say, 140°, which would therefore require the angle between the wings 100 and 200 on the surface-engaging side to be 220°), then when the tool first contacts the tape or bead on either side of the internal corner, it will be the inner portions of the tool, in particular the inner portions of the main wing rollers 110, 120, 210, 220, that will first come into contact with the tape or bead on either side of the corner. Then, when further pressure is applied to the tool (i.e. when the tool is further pressed into the internal corner) this pressure will force the respective wings 100 and 200 to pivot relative to one another such that the angle between the wings on the surface-engaging side decreases as the tool moves into full engagement with the surfaces on either side in the internal corner, until most or all of the length of each main wing roller 110, 120, 210, 220 is in contact with the tape or bead on the respective sides of the internal corner, and the outer rollers 115, 125, 215, 225 may also be in contact with the tape or bead or with portions of the panel on the outside of the tape or bead. (It should be noted that, in embodiments which utilise a flexible band to provide the tool with an inherent bias, as discussed below, it may also sometimes be the case that before the tool comes into contact with the panels (or the tape or bead) on either side of an internal corner, the wings 100 and 200 of the tool may be oriented (relative to one another) such that the angle between the wings on the surface-engaging side is too large. This is because, as mentioned above, the flexible band may bias the tool towards one or other of the tool's range extremes, and the other/second of these range extremes is where the angle between the wings 100 and 200 on the surface-engaging side of the tool at its maximum (approximately 285° in the depicted embodiment).)

The configurations and arrangements of the arms 150 and 250, and the way in which the arms 150 and 250 help the tool to function in the manner described above, will now be explained.

As mentioned above, the lower end of the first arm 150 is pivotally connected to the first wing 100 and the lower end of the second arm 250 is pivotally connected to the second wing 200. The way in which the lower end of each of the arms is pivotably connected to the relevant wing can be understood with reference to FIG. 10.

Figure 10:
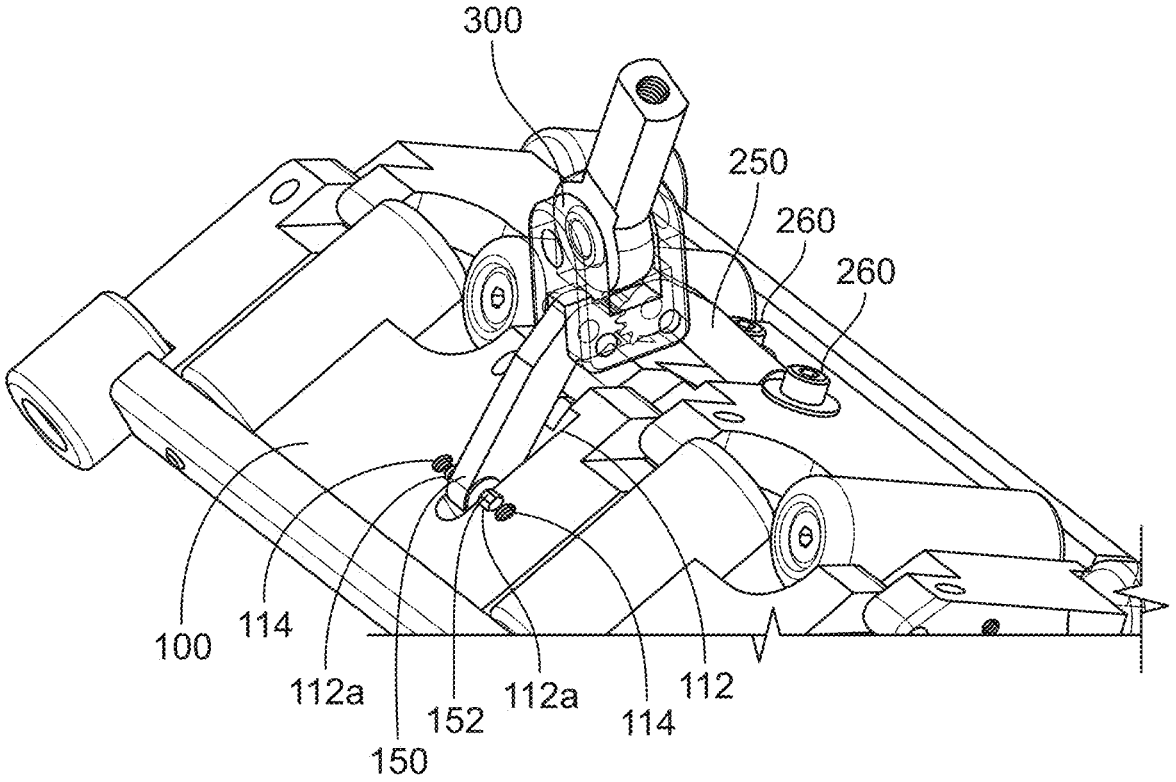
FIG. 10 is another perspective view of the same tool, again shown in a configuration similar to the one in FIG. 3 (except slightly more zoomed in comparison with FIGS. 3 and 9), and in FIG. 10 one of the components via which a handle (not shown) is pivotally connected to the tool (and this is also the component which holds the upper/proximal ends of the arms, being the arms via which pressure from the handle is applied to the respective wings to press the wings into or onto a corner) has been made to appear transparent so that the "geared" portions on the upper/proximal ends of the arms can be seen. A number of the fasteners used to secure the lower/distal end of one of the arms to one of the wings have also been omitted (but the corresponding fasteners used to secure the lower/distal end of the other arm to the other wing are still shown) so that the way in which the arms are pivotally connected to the wings can also be understood.

In FIG. 10, the fasteners 160 that are used to secure the lower end of the first arm 150 to the first wing 100 have been omitted. However, the corresponding fasteners 260 that secure the lower end of the second arm 250 to the second wing 200 are still shown. It can therefore be appreciated from FIG. 10 that, when the tool 10 is being assembled, and more specifically when (for example) the lower end of the first arm 150 is being connected to the first wing 100, a small cylindrical rod/dowel 152 is first inserted through a through-bore in the lower end of the arm 150. Thereafter, the lower end of the arm 150, including with the rod/dowel 152 extending therethrough, is inserted into an aperture 112 in the wing 100. This is clearly illustrated in FIG. 10. It is also shown in FIG. 10 that when the lower end of the arm 150 is inserted into the receiving aperture 112 in the wing 100, the ends of the rod/dowel 152 are also received in extensions 112*a* of the aperture 112 on either side of the arm 150. Thereafter, although not shown in FIG. 10, it will nevertheless be appreciated that the relevant fasteners 160 are inserted (with washers on them) into the threaded holes 114 located just beyond the end of each of the aperture extensions 112*a*. It will be understood that when the fasteners 160

(with washers thereon) are screwed into the holes 114, this secures both ends of the rod/dowel 152 to the wing 100, and this in turn secures the lower end of the arm 150 relative to the wing 100. However, the fact that the rod/dowel 152 is cylindrical (i.e. circular in cross-section) means that the arm 150 remains pivotable relative to the wing 100.

It will be understood that the way in which the lower end of the second arm 250 is pivotably secured relative to the second wing 200 is the same as just described above for the first arm 150.

It is relevant to note that, because of the way the arms 150/250 are pivotally connected to the relevant wings 100/200, the location of the pivotal connection between the lower end of each arm and the relevant wing is actually recessed into or "within" the thickness of the relevant wing. This, and also the configuration of the arms 150/250, the link component 300 and the way it connects the upper ends of the arms to the handle mount component 350, etc, all help to reduce the distance between the pivot axis WP and the location about which the handle is able to pivot relative to the tool. And this (i.e. reducing this distance), in turn, helps to improve the overall stability of the tool.

It is also mentioned above that the upper ends of the respective arms 150 and 250 are pivotally connected to the link component 300. The way in which the upper ends of the arms 150 and 250 are pivotally connected to the link component 300 can, again, be understood from FIG. 10 because the link component 300 has been made to appear transparent in FIG. 10. As can be seen from FIG. 10, the upper ends of each of the arms 150 and 250 are received within a slot on the underside of the link component 300. The upper end of each of arms 150 and 250 is secured within this slot by a rod/dowel (i.e. the upper end of each arm is secured by a respective dowel) which is inserted through a through bore in the upper end of the arm and also through aligned through bores in the portions of the link component on either side of the said slot. Thus, these rods/dowels secure the upper ends of the arms 150/250 within the slot in the underside of the link component 300, but the cylindrical (circular in cross-section) shape of each rod/dowel permits the arms to also pivot relative to the link component 300.

However, it can also be seen from FIG. 10 that, in addition to the fact that the upper end of each arm 150, 250 is pivotally connected to the link component 300 (as just described), the upper ends of the respective arms 150 and 250 also each have a number of "spur gear" like teeth thereon. The gear teeth on the upper end of the first arm 150 engage (i.e. they "mesh") with the gear teeth on the upper end of the second arm 250. The way in which the gear teeth on the upper ends of the respective arms mesh together means that, although both arms are able to pivot relative to the link component, it is not possible for one of the arms to pivot relative to the link component 300 independently of the other arm. Rather, the pivotable movement of the respective arms relative to the link component is "linked" because the meshing of the gears on the respective arms means that, if one of the arms pivots relative to the link component, the other arm is also caused (forced) to pivot relative to the link arm, by the same amount, but in the opposite direction.

This "linking" of the pivotal movement of the respective arms (such that the movement of one arm is always equal but opposite to the movement of the other) is important to the operation of the tool. In particular, this is what ensures that, in use, when the user presses the tool onto an external corner, or into an internal corner, the amount of pressure applied to each of the wings (caused by the pressure which the user applies via the handle) is equal, and it also ensures that the respective wings always (at all times) pivot by the same amount (but in opposite directions) relative to the plane containing the handle. This helps to give the tool it's "self-aligning" functionality, i.e. such that the tool automatically conforms to the shape of the (internal or external) corner on (i.e. into or onto) which the tool is applied. It also significantly improves the stability and usability of the tool.

Figure 11:
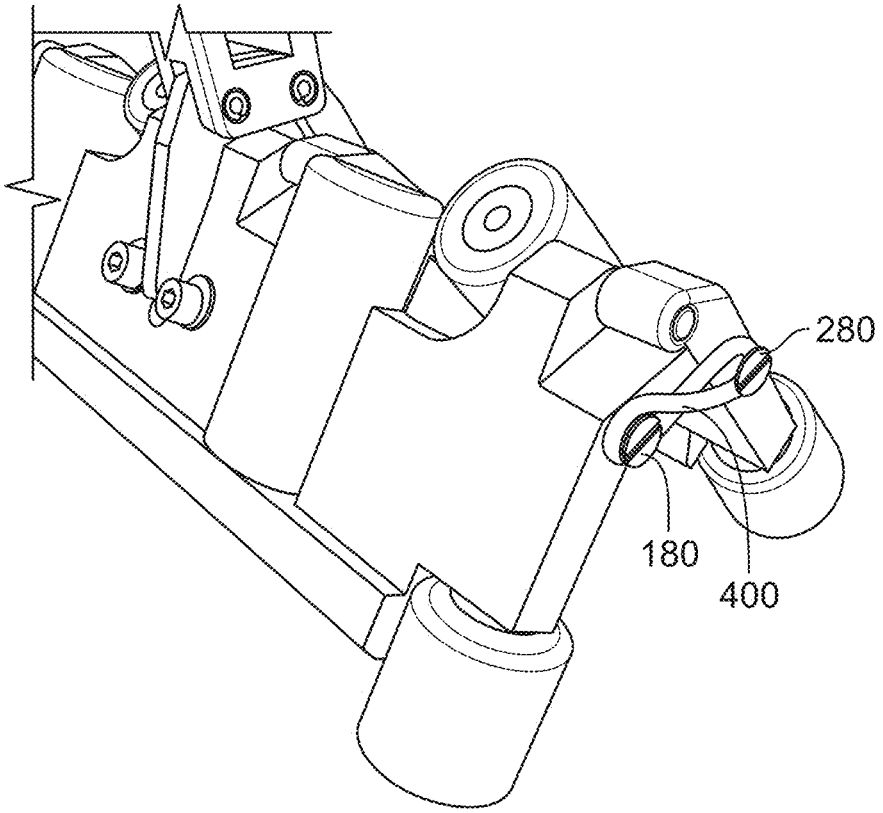
FIG. 11 is an image which shows the relative orientation of the wings of the tool (and hence the relative orientation of the rollers on the respective wings) with an angle between them on the surface-engaging side of the tool close to the first range extreme (i.e. where the angle between the wings is at, or close to, 75°). This is the orientation that the respective wings (and the rollers on the respective wings) would adopt if the tool were to be pressed onto an external corner having an angle of around 285°.
Figure 12:
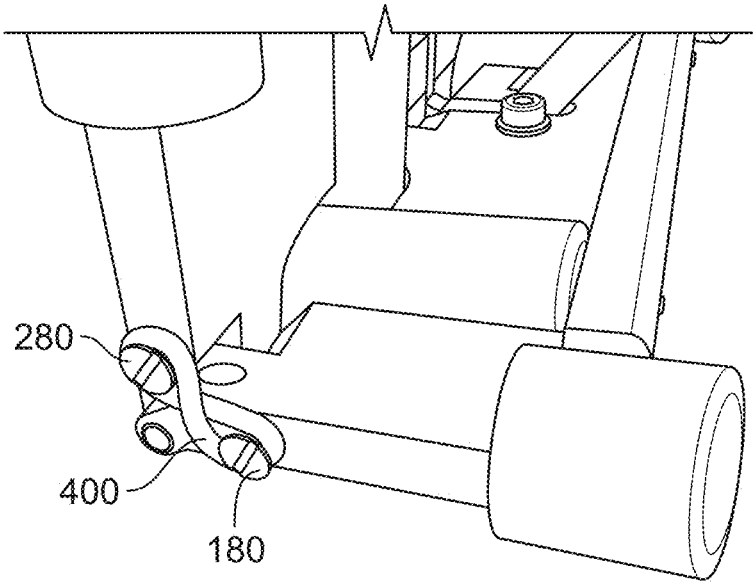
FIG. 12 is an image which shows the relative orientation of the wings of the tool (and hence the relative orientation of the rollers on the respective wings) with an angle between them on the surface-engaging side of the tool that is close to the other range extreme (i.e. where the angle between the wings on the surface-engaging side is at, or close to, 285°). This is the orientation that the respective wings (and the rollers on the respective wings) would adopt if the tool were to be pressed into an internal corner having an angle of around 75°.

Referring next to FIGS. 11 and 12, each of these Figures show how, in this embodiment, a resilient/flexible (e.g. rubber or otherwise elastic) band 400 can be applied to one or both ends of the tool in order to give the tool a natural bias. It will be appreciated that threaded apertures 117 and 217 are provided in the ends of the respective first and second wings 100 and 200, and screws 180 and 280 (or the like) can be screwed into the apertures 117 and 217, so that the elastic band(s) 400 can be installed on the screws 180 and 280 at one or both ends of the tool, for example by wrapping the elastic band(s) around the screws in a "FIG. 8" pattern, as shown in FIGS. 11 and 12. When an elastic band 400 is applied to one or both ends of the tool in this way, the band(s) 400 act in a manner similar to a spring, that is, to provide a resilient bias that biases the tool towards either the first range extreme (note that the configuration shown in FIG. 11 is at, or at least close to, the first range extreme where the angle between the wings on the surface-engaging side of the tool is approximately) 75° or towards the second/other range extreme (note that the configuration shown in FIG. 12 is at, or at least close to, the other range extreme where the angle between the wings on the surface-engaging side of the tool is approximately 285°). Which of these (range extreme) orientations the tool is biased towards depends on the relative orientation of the wings of the tool at a given time. If, at a given time, the angle between the wings on the surface-engaging side is less than 180°, the wings will be biased (by the elastic tension in the band(s) 400) towards (and if all pressure is removed from the tool's wings at that time, the wings will naturally move towards) the configuration shown in FIG. 11. On the other hand, if, at a given time, the angle between the wings on the surface-engaging side is greater than 180°, the wings will be biased (by the elastic tension in the band(s) 400) towards (and again if all pressure is removed from the tool's wings at that time, the wings will naturally move towards) the configuration shown in FIG. 12.

Figure 13:
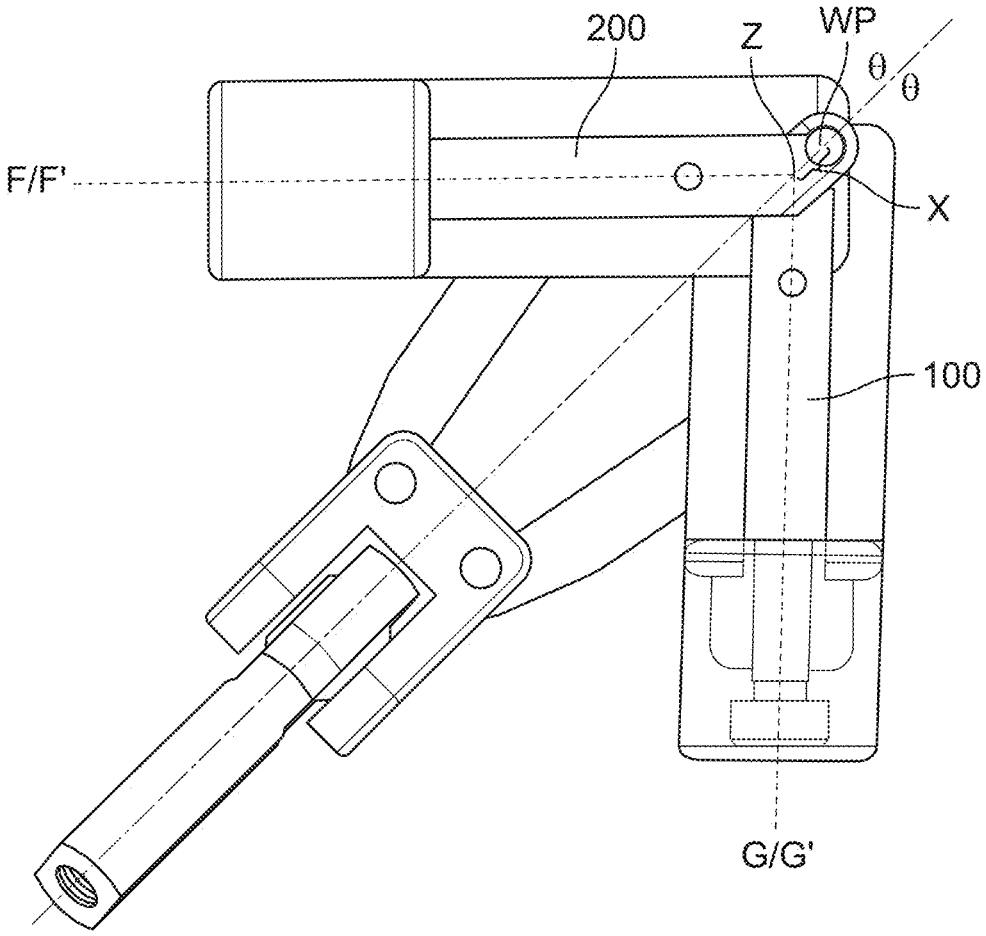
FIG. 13 is an "end-on" view of the tool when the tool is in a 270° internal corner configurations, i.e.

Turning to FIG. 13, this Figure is an "end-on" view of the tool when the tool is in a 270° internal corner configuration. The "end-on" view in FIG. 13 also illustrates the fact that the wing pivot axis WP about which the respective wings 100 and 200 pivot relative to one another is offset by a distance X from (and it is closer by the distance X to the apex of an internal corner than) the location of the intersection between the axes F and G about which the respective rollers on each wing rotate (the location of this intersection is marked as Z). In other words, the axis WP about which the respective wings pivot relative to one another is offset by the distance X from, and it is closer by the distance X to, the apex of an internal corner than the location Z where a plane F' which contains the axes about which the rollers on one wing rotate intersects with a plane G' which contains the axes about which the rollers on the other wing rotate. This geometry is preferable because it assists the inner ends of the respective main wing rollers 110, 120, 210, 220 to be closer to the apex of an internal corner when the tool in this kind of "internal-corner-rolling" configuration (and this is important for ensuring that the tape or bead used on the internal corner is pressed as closely as possible into the apex of the corner). In previous adjustable roller tools designs, the axis about which the respective wings pivot relative to one another was not offset from (and it certainly was not closer to the apex of the corner than) the location of the intersection between the axes about which the rollers rotate.

Also, for reasons explained above (i.e. because of the way the movement of the arms, and hence the movement of the wings, is "linked", such that the movement and angle of one arm (and its wing) will always be equal and opposite to the movement and angle of the other arm (and its wing), it follows that the angle θ that one wing (and the rollers thereon) forms to the plane containing the handle will always be equal to the angle θ that the other wing (and the rollers thereon) forms to the plane containing the handle. This is particularly helpful when rolling internal corners as it helps to enable the user to provide an accurate centre line for aligning and bedding the tape or bead in the internal corner.

In this specification, the term "comprising" is (and likewise variants of the term such as "comprise" or "comprises" are) intended to denote the inclusion of a stated integer or integers, but not necessarily the exclusion of any other integer, depending on the context in which the term is used.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

What is claimed is:

1. A roller tool for use in plasterboard finishing, the tool having a first wing and a second wing, wherein the first wing is pivotably connected to the second wing, one or more first wing rollers connected to, and able to pivot/roll relative to, the first wing, and one or more second wing rollers connected to, and able to pivot/roll relative to, the second wing, wherein, in use, the tool can be pressed against surfaces on respective sides of a joint or line where adjacent plasterboard panels on either side of that joint or line meet or come together, such that the first wing roller(s) contact with the surface on one side of the joint or line and the second wing roller(s) contact with the surface on the other side of the joint or line, and when the tool is pressed against the surfaces on the respective sides of the joint or line, the first wing and the second wing of the tool self-align with the plasterboard panels on the respective sides of the joint or line, such that the first wing roller(s) become(s) correctly oriented relative to the plasterboard panel(s) on one side of the joint or line (to press perpendicularly against (including while rolling along the surface of) the plasterboard panel(s) on that side of the joint or line), and the second wing roller(s) become(s) correctly oriented relative to the plasterboard panel(s) on the other side of the joint or line (to press perpendicularly against (including while rolling along the surface of) the plasterboard panel(s) on that other side of the joint or line).

2. A roller tool for use in plasterboard finishing as claimed in claim 1, wherein the first wing and the second wing can pivot relative to one another such that the angle between the first wing and the second wing on a surface-engaging side of the tool can be any angle in between (and including) two range extremes.

3. A roller tool for use in plasterboard finishing as claimed in claim 2, wherein at a first of the range extremes, the angle α between the first wing and the second wing on the surface-engaging side of the tool is between 90° and 180°.

4. A roller tool for use in plasterboard finishing as claimed in claim 2, wherein at the first of the range extremes, the angle α between the first wing and the second wing on the surface-engaging side of the tool is at least as low as 90°.

5. A roller tool for use in plasterboard finishing as claimed in claim 2, wherein at a second of the range extremes, the angle α between the first wing and the second wing on the surface-engaging side of the tool is between 180° and 270°.

6. A roller tool for use in plasterboard finishing as claimed in claim 2, wherein at the second of the range extremes, the angle α between the first wing and the second wing on the surface-engaging side of the tool is at least at as high as 270°.

7. A roller tool for use in plasterboard finishing as claimed in claim 1, wherein the first wing and the second wing both have one or more cut-outs and/or other shaped portions the shape and/or configuration of which enables the first and second wings to pivot relative to one another without the roller(s) on one wing colliding with the other wing.

8. A roller tool for use in plasterboard finishing as claimed in claim 1, wherein a handle can be connected to the tool, and when connected the handle is connected to the first wing and also to the second wing.

9. A roller tool for use in plasterboard finishing as claimed in claim 8, wherein the tool further includes a linking component, and the handle is connected to the tool via the linking component.

10. A roller tool for use in plasterboard finishing as claimed in claim 8, wherein the tool has a first force transfer mechanism via which some force/pressure applied to the tool by the handle is transferred to the first wing, and a second force transfer mechanism via which some force/pressure applied to the tool by the handle is transferred to the second wing.

11. A roller tool for use in plasterboard finishing as claimed in claim 10, wherein the amount of pressure/force from the handle which is transferred to the first wing by the first force transfer mechanism is equal to the amount of pressure/force from the handle which is transferred to the second wing by the second force transfer mechanism.

12. A roller tool for use in plasterboard finishing as claimed in claim 9, wherein the tool includes a first force transfer member which is pivotally connected to the first wing, and the tool also includes a second force transfer member which is pivotally connected to the second wing.

13. A roller tool for use in plasterboard finishing as claimed in claim 12, wherein the first force transfer member and the second force transfer member each also have a portion that is pivotally connected to the linking component.

14. A roller tool for use in plasterboard finishing as claimed in claim 13, wherein the first and second force transfer members can both pivot relative to the linking component, but the movement of the first and second force transfer members relative to the linking component is linked such that the movement of the second force transfer member is always equal and opposite to the movement of the first force transfer member.

15. A roller tool for use in plasterboard finishing as claimed in claim 1, wherein an edge portion of the first wing is connected to an edge portion of the second wing in a manner that permits the wings to pivot relative to one another about a wing pivot axis, and when the tool is configured with the first wing and the second wing pivoted relative to one another to enable the first wing rollers and the second wing rollers to roll respective sides of an internal corner having an angle that is less than 180°, the wing pivot axis is located closer to the apex of the internal corner than a point of intersection between an axis about which the first wing roller(s) rotate and an axis about which the second wing roller(s) rotate.

16. A roller tool for use in plasterboard finishing, the tool having a first wing and a second wing, wherein an edge portion of the first wing is connected to an edge portion of the second wing in a manner that permits the wings to pivot relative to one another about a wing pivot axis, one or more first wing rollers which are connected to, and which are able to pivot/roll relative to, the first wing about a first wing roller axis, and one or more second wing rollers which are connected to, and able to pivot/roll relative to, the second wing about a second wing roller axis, wherein, when the tool is configured with the first wing and the second wing pivoted relative to one another to enable the first wing rollers and the second wing rollers to roll in an internal corner having an angle that is less than 180°, the wing pivot axis is located closer to the apex of the internal corner than the point of intersection between the first wing roller axis and the second wing roller axis.

* * * * *